US005674672A

United States Patent [19]

Kawamoto

[11] Patent Number: 5,674,672

[45] Date of Patent: Oct. 7, 1997

[54] CONTINUOUS SILVER HALIDE PHOTOGRAPHIC SHEET AND PROCESS FOR PREPARATION OF THE SAME

[75] Inventor: Fumio Kawamoto, Kanagawa, Japan

[73] Assignee: Fuji Photo Film Co., Ltd., Ashigara, Japan

[21] Appl. No.: 563,291

[22] Filed: Nov. 28, 1995

[30] Foreign Application Priority Data

Nov. 28, 1994 [JP] Japan ..... 6-292968

[51] Int. Cl.[6] ..... G03C 1/76

[52] U.S. Cl. ..... 430/533; 430/534; 430/535; 430/523; 430/495; 430/496

[58] Field of Search ..... 430/533, 534, 430/535, 523, 495, 496

[56] References Cited

U.S. PATENT DOCUMENTS

| | | | |
|---|---|---|---|
| 5,294,473 | 3/1994 | Kawamoto | 430/523 |
| 5,312,725 | 5/1994 | Araki et al. | 430/533 |
| 5,368,997 | 11/1994 | Kawamoto | 430/533 |
| 5,372,925 | 12/1994 | Kobayashi et al. | 430/533 |
| 5,407,791 | 4/1995 | Kawamoto | 430/532 |
| 5,436,123 | 7/1995 | Suzuki | 430/533 |
| 5,462,824 | 10/1995 | Kawamoto et al. | 430/533 |
| 5,496,687 | 3/1996 | Kawamoto | 430/496 |

*Primary Examiner*—Geraldine Letscher
*Attorney, Agent, or Firm*—Burns, Doane, Swecker & Mathis, LLP

[57] ABSTRACT

A continuous silver halide photographic sheet comprises a continuous support which has Young's modulus of 450 to 650 kg/mm$^2$ in both of its length and width directions and has a knurled area in the form of a belt on each side, at least one subbing layer formed on the support; and at least one silver halide emulsion coated on the subbing layer not only in an area between both knurled areas but also in the knurled areas under the condition that each of the knurled areas has an area in the form of a belt having emulsion coating which has a width of 5 to 95% of the width of the belt of knurled area. Further, a process for preparing the continuous silver halide photographic sheet comprises the steps of forming at least one subbing layer on the support, and coating at least one silver halide emulsion on the subbing layer in the areas described above.

15 Claims, 2 Drawing Sheets

CONTINUOUS SILVER HALIDE PHOTOGRAPHIC SHEET AND PROCESS FOR PREPARATION OF THE SAME

FIELD OF THE INVENTION

The present invention relates to a continuous silver halide photographic sheet in which fog easily occurring during handling or storage in the form of roll is reduced, and a process for preparation of the sheet.

BACKGROUND OF THE INVENTION

A continuous photographic sheet is generally produced as described below. One or more subbing layer is formed by coating on a continuous plastic film support which is fed from plastic film roll, while the coated support is wound in the form of roll. Then, one or more silver halide emulsion layer (light-sensitive layer) is formed by coating on the plastic film support having the subbing layer while the coated support is also wound in the form of roll. Thus, the support and the coated supports are handled or stored in the from of roll.

The continuous plastic film support has knurled areas (embossed areas) on both sides. In more detail, the knurled areas are formed in the form of belt (width: about 5–20 mm) on both sides of the support. The film support is wound to form its roll (i.e., form a number of layers of the film support), and the support is stored in this form. The layers of film support are mainly supported by the knurled areas, because the top of the knurled areas is higher than that of the area formed between the knurled areas. The friction in the knurled areas is increased and therefore the knurled areas bring about firmly wound roll. Further, the knurled areas prevent load of a number of layers (roll) from pressing each of the layers in an area formed between both knurled areas.

The knurled area is also considered to function in the same manner as mentioned above for the continuous silver halide photographic sheet in the form of roll. Hence, the continuous photographic sheet in the form of roll is almost free from occurrence of fog by pressure or scratch. The fog by pressure is produced while the sheet is stored in the form of roll which gives a large load to the silver halide emulsion layer of each of layers of the sheet roll. The fog by scratch is produced when the coated support of the silver halide emulsion layer is wound.

As the film support, a triacetyl cellulose film (hereinafter referred to as "TAC film") is usually employed. Recently, a poly(ethylene-2,6-naphthalate) film (hereinafter referred to as "PEN film") has employed as the support because its use enables preparation of a thin film support.

In the case that the continuous photographic sheet in the form of roll is prepared using a PEN film as a support, however, occurrence of fog by pressure or scratch is found, particularly in the case of having a silver halide emulsion layer of high sensitivity or a silver halide emulsion layer containing silver halide of high aspect ratio.

SUMMARY OF THE INVENTION

In the preparation of a continuous silver halide photographic sheet in the form of roll, it is proposed to form the silver halide emulsion layer on the film support in an area between knurled areas (i.e., area having no knurled areas) in order to reduce the amount of silver halide emulsion (i.e., silver) using for coating. Therefore, in the case that the thickness of the silver halide emulsion layer is more than the height of protrusions of the knurled areas, the silver halide emulsion layer is directly brought about into contact with the film support of the continuous photographic sheet (wound in the form of roll) which is superposed on the silver halide emulsion layer. This condition (the sectional view) is shown in FIG. 1. The film support 11*a* has two knurled areas 12*a*, 12*b* on both sides. The knurled area comprises fine protrusion and depression, and the protrusion is about 10–20 μm high on the basis of a surface of the support. A subbing layer 13 and a silver halide emulsion layer 14 are formed in order on the support, and the formed area of the silver halide emulsion layer 14 is a surface between two knurled areas 12*a*, 12*b*. Thus, the top surface of the silver halide emulsion layer is positioned over that of the knurled areas 12*a*, 12*b*. Therefore, the silver halide emulsion layer is directly in contact with the back side of the TAC film support 11*b* of the continuous photographic sheet pilled when the sheet is wounded to form a roll.

However, there are few occurrences of fog on the continuous photographic sheet in the case of using TAC film as the support. This is considered because the TAC film support has a low Young's modulus to absorb and relax impact or pressure, according to study of the inventor. Although the formation of the silver halide emulsion layer on the TAC film support is occasionally performed in an area containing a portion or all of knurled areas, occurrence of fog is hardly found.

The inventor had findings that in the case that the silver halide emulsion layer is formed by coating on an area between knurled areas of a hard polymer such as a poly (ethylene-2,6-naphthalate) (PEN) film support so as not to form the area between knurled areas in the same manner as above, a number of occurrences of fog are produced. The inventor considers that this is because the PEN film has a high Young's modulus compared with the TAC film. Further, the inventor has studied to obtain a continuous photographic sheet in the form of roll using a PEN film support which is almost free from occurrence of fog, and attained to the invention, which can be applied to a hard polymer having the specific high Young's modulus such as a PEN film support or a poly(ethylene terephthalate) (PET) film support.

It is an object of the present invention to provide a continuous silver halide photographic sheet which is almost free from occurrence of fog easily occurring during handling or storage in the form of roll.

It is another object of the present invention to provide a process for preparing in high yield a continuous silver halide photographic sheet which is almost free from fog easily occurring during handling or storage in the form of roll.

There is provided by the present invention a continuous silver halide photographic sheet which comprises:

- a continuous support which has Young's modulus in the range of 450 to 650 kg/mm$^2$ in both of its length and width directions and has a knurled area in the form of a belt on each side;
- at least one subbing layer formed on the support; and
- at least one silver halide emulsion layer coated on the subbing layer not only in an area between both knurled areas but also in the knurled areas under the condition that each of the knurled areas has an area in the form of a belt having emulsion coating which has a width of 5 to 95% of the width of the belt of knurled area.

Preferred embodiments of the continuous silver halide photographic sheet of the invention as follows:

1) The photographic sheet wherein the support of polymer film comprises an aromatic polyester.

2) The photographic sheet wherein the support of polymer film comprises poly(ethylene terephthalate) or poly (ethylene-2,6-naphthalate), especially poly(ethylene-2, 6-naphthalate).

3) The photographic sheet wherein the support of polymer film has a width of 1 to 5 m and a length of 1,000 to 5,000 m.

4) The photographic sheet wherein the support of polymer film has a thickness of 60 to 100 μm.

5) The photographic sheet wherein the knurled area has protrusions having an average height of 5 to 50 μm (preferably 15 to 30 μm), said height being measured from a surface of the support in the area between both knurled areas.

6) The photographic sheet wherein the knurled area has a width of 3 to 20 mm.

7) The photographic sheet wherein the silver halide emulsion layer has a thickness of 15 to 30 μm.

8) The photographic sheet wherein the silver halide emulsion layer has sensitivity of not less than ISO 100 (which is based upon International Organization for Standardization).

9) The photographic sheet wherein the silver halide emulsion layer contains silver halide grains in the form of flat plate having an aspect ratio of not less than 2, in an amount corresponding to not less than 30% of a total projected area of all silver halide grains.

10) The photographic sheet which is wound to give a continuous photographic sheet in the form of a roll.

The continuous silver halide photographic sheet can be advantageously obtained by a process which comprises the steps of:

forming at least one subbing layer on a continuous support of polymer film which has a Young's modulus in the range of 450 to 650 kg/mm$^2$ in both of its length and width directions and has a knurled area in the form of a belt on each side; and coating at least one silver halide emulsion on the subbing layer not only in an area between both knurled areas but also in the knurled areas under the condition that each of the knurled areas has an area in the form of a belt having emulsion coating which has a width of 5 to 95% of the width of the belt of knurled area.

Preferred embodiments of the process of the invention as follows:

1) The process wherein the support of polymer film comprises an aromatic polyester.

2) The process wherein the support of polymer film comprises poly(ethylene terephthalate) or poly (ethylene-2,6-naphthalate), especially poly(ethylene-2, 6-naphthalate).

3) The process wherein the support of polymer film has a width of 1 to 5 m and a length of 1,000 to 5,000 m.

4) The process wherein the support of polymer film has a thickness of 60 to 100 μm.

5) The process wherein the knurled area has protrusions having an average height of 5 to 50 μm (preferably 15 to 30 μm), said height being measured from the support in the area between both knurled areas.

6) The process wherein the knurled area has a width of 3 to 20 mm.

7) The process wherein the silver halide emulsion is coated to give a silver halide emulsion layer having a thickness of 15 to 30 μm.

8) The process mentioned above 7) wherein the silver halide emulsion layer has sensitivity of not less than 100 which is based upon International Organization for Standardization.

9) The process wherein the silver halide emulsion contains silver halide grains in the form of flat plate having aspect ratio of not less than 2, in an amount corresponding to not less than 30% of a total projected area of all silver halide grains.

10) The process wherein the support on which the silver halide emulsion has been coated is further wounded at an initial tension of 30 to 100 kg/m and final tension of 30 to 100 kg/m.

11) The process wherein the support on which the silver halide emulsion is coated has been beforehand subjected to heat treatment at a temperature of 50° C. to glass transition temperature of the support.

The continuous silver halide photographic sheet of the invention has a basic structure comprising a support of polymer film having a high Young's modulus such as PET or PEN film having a knurled areas on each side, at least one subbing layer provided thereon and at least one silver halide emulsion layer provided on the subbing layer. The sheet is characterized in that the silver halide emulsion layer is formed not only in an area between both knurled areas but also in a partial area of the knurled areas mentioned above.

By forming the silver halide emulsion layer on the partial area of the knurled areas, the support piled on the silver halide emulsion layer of the continuous photographic sheet which is wound in the form of roll is supported by the silver halide emulsion layer in the partial area, and therefore is hardly in contact with the silver halide emulsion layer on the area having no knurled area. Thus, even the emulsion layer of the continuous silver halide photographic sheet using the support of a high Young's modulus is almost free from fog by pressure or scratch.

Particularly, the continuous silver halide photographic sheet of the invention is suitable in the case of having a silver halide emulsion layer of high sensitivity or a photographic layer containing silver halide of high aspect ratio.

Further, the process for preparation of the sheet of the invention gives the continuos photographic sheet without occurrence of fog by pressure or scratch, and therefore the process can produce the sheet in high productivity.

DETAILED DESCRIPTION OF THE INVENTION

In the invention, the support for the continuous silver halide photographic sheet is a polymer film which has a Young's modulusin the range of 450 to 650 kg/mm$^2$ in both of its length and width directions and has a knurled area in the form of a belt on each side. Examples of the polymer film include poly(ethylene terephthalate) and poly(ethylene-2,6-naphthalate)). At least one subbing layer provided thereon and at least one silver halide emulsion layer provided on the subbing layer. The silver halide emulsion layer is formed not only in an area between both knurled areas but also in a partial area of the knurled areas mentioned above.

Figure 1:
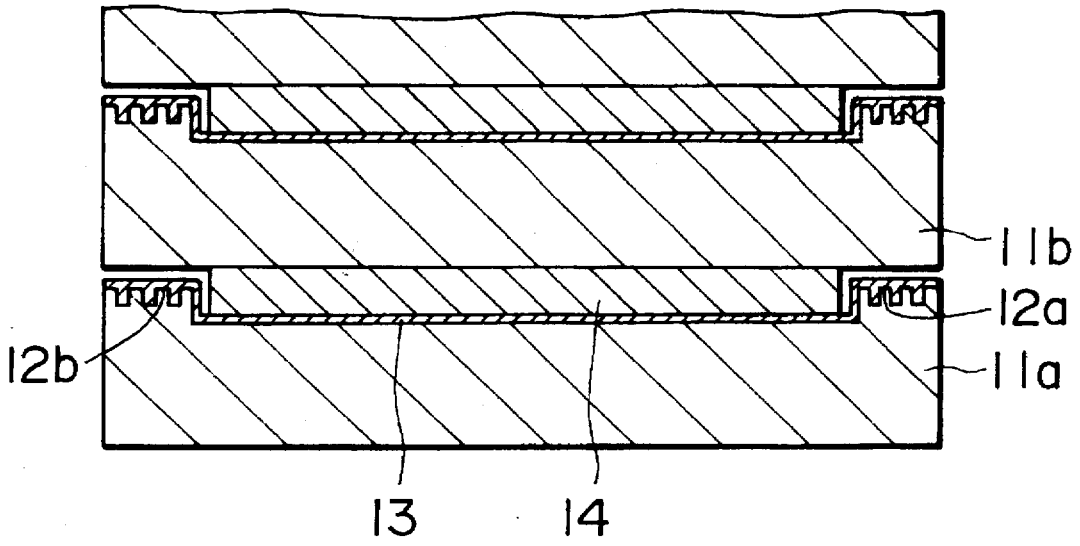
FIG. 1 shows a sectional view of a known continuous silver halide photographic sheet in the form of roll.
Figure 2:
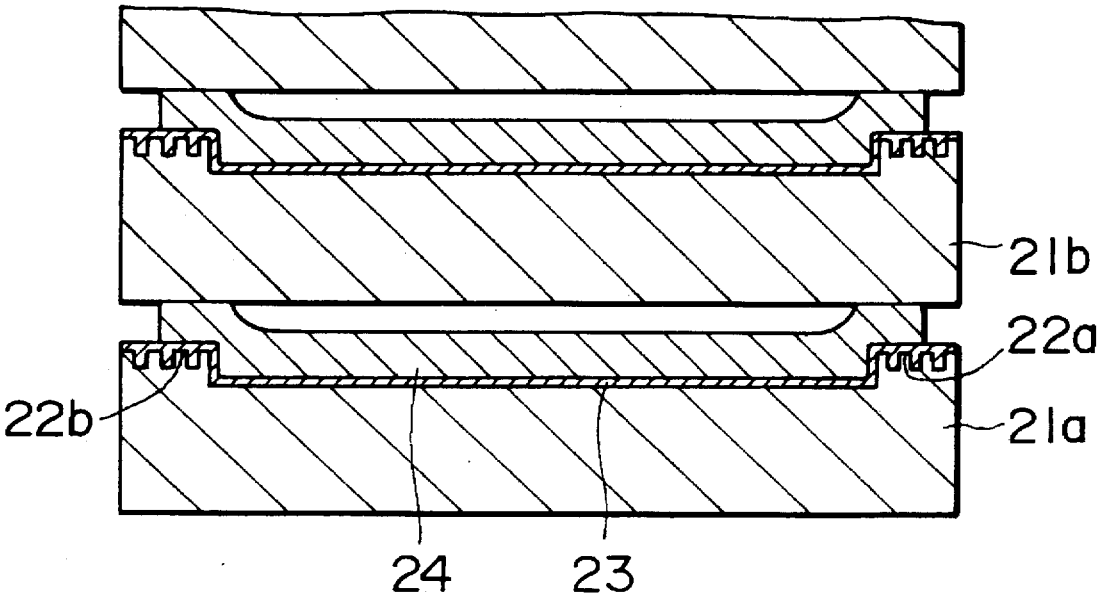
FIG. 2 shows a sectional view of a continuous silver halide photographic sheet in the form of roll of the invention.

FIG. 2 shows a sectional view of the continuous silver halide photographic sheet in the form of roll of the invention. The film support 21*a* having high Young's modulus has two knurled areas 22*a*, 22*b* on both sides. A subbing layer 23 and a silver halide emulsion layer 24 are formed in order on the support, and the silver halide emulsion layer 24 is provided not only in area of an area having no knurled area (area between the two knurled areas 22*a*, 22*b*) but also in an partial area of the two knurled area adjacent to the area having no knurled area. Therefore, each of the knurled areas has an area in the form of a belt having emulsion coating which has a width of 5 to 95% of the width of the belt of knurled area. The subbing layer is generally formed on the almost whole surface of the support. The sheet is wound and the support 21*b* is piled on the emulsion layer 24.

Figure 3:
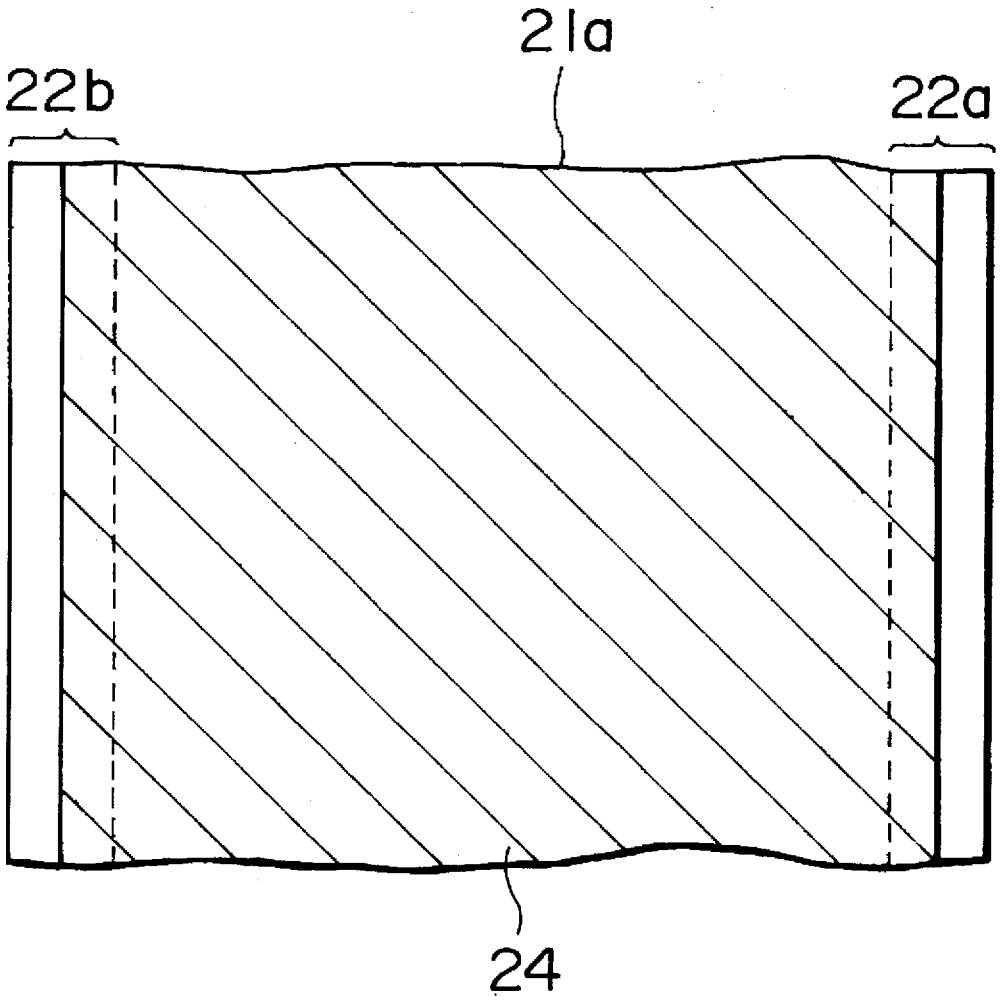
FIG. 3 shows a plane view of a continuous silver halide photographic sheet of FIG. 2 of the invention.

FIG. 3 shows a plane view of the continuous silver halide photographic sheet of FIG. 2, in which the support 21*b* is removed. The film support 21*a* having high Young's modulus has two knurled areas 22*a*, 22*b* on both sides. The silver halide emulsion layer 24 is provided in an area having no knurled area (area between the two knurled areas 22*a*, 22*b*) and in an partial area of the two knurled areas 22*a*, 22*b*.

As described above, the silver halide emulsion layer is also formed in an partial area of the two knurled areas, and therefore the top of the silver halide emulsion layer in the knurled area is higher than that of the photographic layer in the area having no knurled area. Hence, a support 21*b* of the silver halide photographic sheet which is piled by winding on the silver halide emulsion layer 24, should be supported by the silver halide emulsion layer 24 formed on the knurled areas 22*a*, 22*b*. The back side of the support piled on the silver halide emulsion layer 24 is hardly in contact with the silver halide emulsion layer 24 on the area having no knurled area. By the formation of the silver halide emulsion layer as above, even the silver halide photographic sheet using a support of a high Young's modulus is almost free from fog caused by pressure or scratch.

The knurled area is formed in the form of a belt on the surface in the vicinity of both edges in width direction of the support. The knurled area generally is formed in an area between a position of 0 to 10 mm from its edge in width direction and that of 3 to 20 mm from the edge, and preferably in an area between a position of 0 to 7 mm from its edge and that of 3 to 20 mm from the edge. The width of the knurled area generally is in the range of 3 to 20 mm, preferably in the range of 5 to 15 mm, and especially is in the range of 7 to 13 mm.

The knurled area has protrusions having an average height of 5 to 50 μm (preferably 15 to 30 μm), said height being measured from the surface of support in the area between both knurled areas. In other words, the top surface of the knurled area generally is 5 to 50 μm high on the basis of that of the support having no knurled area.

In the invention, each of the knurled areas has an area in the form of a belt having emulsion coating which has a width of 5 to 95% of the width of the belt of knurled area, as described above. The emulsion coating (which is dried to form a silver halide emulsion layer) in the knurled area preferably has a width of 10 to 50% of the width of the belt of knurled area, especially from 15 to 35% of the width of the belt of the knurled area. When the area of the silver halide emulsion layer is smaller than 5% of the width of the belt of the knurled area, the resultant silver halide emulsion layer easily suffers from product of fog by pressure or scratch or from scratch damage. When the area of the silver halide emulsion layer is larger than 95% of the width of the belt of the knurled area, the resultant silver halide emulsion layer is apt to form a loosely wound roll. Such a wound sheet (roll) gives trouble to thereafter process (e.g., transfer, cutting and perforation). Further, when the emulsion is coated in the area of more than 95%, the emulsion occasionally stains a coating machine such as a roll.

Any polymer is employable for the support, so long as the resultant polymer film shows Young's modulus of 450 to 650 kg/mm$^2$ in both of its length and width directions. The polymer generally is a polyester such as poly(ethylene terephthalate) or poly(ethylene-2,6-naphthalate). The polyester preferably is poly(ethylene-2,6-naphthalate) derived mainly from 2,6-naphthalene dicarboxylic acid and ethylene glycol. Into the poly(ethylene-2,6-naphthalate), other ingredients other than 2,6-naphthalene dicarboxylic acid and ethylene glycol may be incorporated as a copolymer ingredient or a polymer for blend. The content of the ingredient or polymer preferably is not more than 10 molar and more preferably not more than 5 molar %.

The poly(ethylene-2,6-naphthalate) can be synthesized by a conventional method. For example, the synthesis is conducted by direct esterification of a dibasic acid and glycol, by ester interchange of a dialkylester of a dibasic acid and glycol and remove of excess glycol under heating and reduced pressure, or by reaction of an acid halide of dibasic acid (instead of dibasic acid) with glycol. In the synthesis, ester interchange may be carried out, or a catalyst, an initiator and a thermal stabilizer may be added.

Into the poly(ethylene-2,6-naphthalate), a copolymer or blend polymer containing at least one ingredient other than 2,6-naphthalene dicarboxylic acid and ethylene glycol may be incorporated, for example, by adding before completion of polyester reaction of polyethylene-2,6-naphthalate.

Preferred examples of other ingredients include a dibasic acid such as terephthalic acid, isophthalic acid, phthalic acid, phthalic anhydride, succinic acid, adipic acid, oxalic acid or lower alkyl ester thereof; oxycarboxylic acid such as p-oxybenzoic acid, p-oxyethoxybenzoic acid or lower alkyl ester thereof; or glycol such as propylene glycol or trimethylene glycol. The hydroxyl or carboxy group at the end portion of the poly(ethylene-2,6-naphthalate) may be terminated with a mono-functional compound such as benzoic acid, benzoylbenzoic acid, benzyloxybenzoic acid or methoxypolyalkylene glycol. Otherwise, the polyethylene-2,6-naphthalate may be denatured with a slight amount of 3- or 4-functional compound such as glycerol or pentaerythritol.

In the support of the invention, the Young's modulus in length direction (EM) is in the range of 450 to 650 kg/mm$^2$, preferably 500 to 650 kg/mm$^2$ and more preferably 550 to 650 kg/mm$^2$. The Young's modulus in width direction (ET) in the range of 450 to 650 kg/mm$^2$, preferably 500 to 650 kg/mm$^2$ and more preferably 550 to 650 kg/mm$^2$.

In the case of the support of poly(ethylene-2,6-naphthalate) of the invention, the Young's modulus in length direction (EM) generally is in the range of 550 to 650 kg/mm$^2$, preferably 550 to 620 kg/mm$^2$ and especially 550 to 600 kg/mm$^2$. The Young's modulus in width direction (ET) generally is in the range of 550 to 650 kg/mm$^2$, preferably 550 to 620 kg/mm$^2$ and more preferably 550 to 600 kg/mm$^2$. When the difference between the Young's modulus in length direction (EM) and the Young's modulus in width direction (ET) is increased, tear propagation strength in either direction of the film lowers. Therefore, the difference is generally not more than 80 kg/mm$^2$, preferably not more than 50 kg/mm$^2$, and more preferably not more than 30 kg/mm$^2$.

The breaking elongation of the support generally is not less than 70% in both of its length and width directions, preferably 70 to 200%, more preferably 80 to 200% and especially 90 to 200%.

The support generally has a thermal shrinkage factor of not more than 0.3% (0 to 0.3%) after allowing it to stand at 110° C. for 30 minutes, preferably 0 to 0.2%, and more preferably 0 to 0.15%.

In the support, the difference between the saturated shrinkage factors in length and width directions generally is not more than 0.4% at a temperature of 200° C., and preferably not more than 0.3%. The support having the above thermal shrinkage factor and/or the above difference between the saturated shrinkage factors exhibits an improved dimensional stability and reduced curling tendency.

The aromatic polyester such as poly(ethylene-2,6-naphthalate) generally has an intrinsic viscosity of not lower than 0.45 based on a viscosity (e.g., a number of second) measured in o-cresol at 35° C. The intrinsic viscosity generally is in the range of 0.45 to 1.2, preferably in the range of 0.50 to 1.2 and more preferably in the range of 0.55 to 1.2. In the case of less than 0.45, the strength of the resultant polymer lowers and therefore such polymer is not suitable for the support of the silver halide photographic sheet.

The support having the above specific Young's modulus of the invention is, for example, prepared by subjecting a polymer film to biaxial stretching (biaxial orientation), heat-setting and heat-relaxation through controlling their various operation conditions.

First, a polymer such as polyester material is fused. The polyester material is fused by heating at temperature between a melting point (Tm) of the polyester to (Tm+70° C.). The melted (fused) polyester is extruded to obtain the polyester film. Thereafter the film is subjected to biaxial stretching simultaneously or successively in a length direction and in a widthe direction. Each of the stretchings in the both directions is generally carried out in the range of 2.5 to 5.0 times (preferably 2.8 to 3.8) its original rength, at temperature in the range of the glass transition point (Tg) to (Tg+70° C.). The biaxial stretching is preferably performed so as to have an area in the range of 9 to 22 times its original area, and more preferably 12 to 22 times its original area. The stretching in a length direction or a width direction may be conducted in two or more times.

In the support of the invention, the above biaxial stretching process is performed in the specific conditions in order to improve curling tendency (i.e., tendency curling by winding the support). The stretching process is usually carried out by regulating stretching speed in addition to a stretching temperature and stretching magnification. The stretching rate (speed) is preferably regulated at 30%/sec. to 200%/second in the both lengthwise and widthwise directions, more preferably 30%/sec. to 130%/sec., most preferably 30%/sec. to 100%/sec.

The support having the above specific Young's modulus is advantageously obtained by generally stretching at a relatively high temperature and at a relatively slow speed.

When the stretching is conducted less than 2.5 times its original length, the resultant film does not show satisfactory flexibility. When the stretching is conducted more than 5.0 times, the resultant polyester film does not show satisfactory bending strength, i.e., show increased brittleness. Thus, the film stretched in the range of the above stretching magnification is enhanced in flexibility without reduction of bending strength.

The stretched film is preferably subjected to heat setting treatment (heat-set). The heat setting treatment is generally conducted at (Tg+70° C.) to Tm (melting point), preferably at the temperature of 190° to 260° C. and more preferably at the temperature of 220° to 260° C. The time period for the heat setting treatment preferably is 1 to 60 seconds.

The polymer film may be further subjected to heat relaxation treatment. For instance, the film is subjected to the heat relaxation at the creep temperature.

The stretched film, before provision of a silver halide emulsion layer thereon, is subjected to the heat treatment so that a free volume (strain) is relaxed. A subbing layer and/or backing layer is provided on the stretched film support to form a composite, and further the composite is subjected to the heat treatment at a temperature of 50° C. to Tg. The heat treatment brings about improvement of the curling tendency.

The effect of the heat treatment is rapidly given with enhancing the temperature. Therefore, the heat treatment is generally performed in the range from a temperature 50 degree (°C.) lower than Tg to Tg, preferably in the range of (Tg−25° C.) to Tg and more preferably in the range of (Tg−15° C.) to Tg. For example, a support of poly(ethylene-2,6-naphthalate) is generally subjected to the heat treatment at a temperature of 95° C. to 120° C. (i.e., Tg), preferably at a temperature of 100° C. to 115° C., and especially at a temperature of 105° C. to 115° C.

The heat treatment may be performed at a constant temperature in the above range, or performed with increasing or decreasing the temperature in the range. The heat treatment is preferably performed by cooling at an average cooling rate of −20° to −0.01° C./minute at a temperature from the glass transition temperature to a temperature 40° C. lower than the glass transition temperature. The average cooling speed preferably is −10° to −0.1° C./minute, especially −5° to −0.2° C./minute.

The effect of the heat treatment can be obtained when the treatment is generally performed for 0.1 hour or more. On the other hand, even when the treatment is performed for 1,500 hours or more, the effect attains to the saturated condition. Hence, the heat treatment is generally performed for a period of 0.1 to 1,500 hours, preferably 2 to 1,000 hours, especially 5 to 500 hours.

In order to reduce the time period for the heat treatment, the polymer film is, before the heat treatment, preferably pre-heated at a temperature higher than the glass transition temperature (Tg) for a short time and is more preferably pre-heated at a temperature between a temperature 20° C. higher than Tg and 100° C. for 5 minutes to 3 hours.

In the heat treatment, the film may be heated in the form of roll (in wound state) by allowing the film to stand in a house for heating, or be heated in the form of film by transferring the film into a heating zone (or passing through a heat roll). Otherwise, these heating methods may be utilized in combination. In the case of heating in the form of roll, the film is preferably wrapped with a double or triple layer using insulation such as glass fiber for preventing it from occurrence of shrinkage or wrinkles.

The core of the roll employed in the heat treatment preferably has a hollow shape, or preferably has a heater therein or a structure wherein a liquid for heating can be circulated so as to effectively conduct heat into the roll. Although materials of the core are not particularly restricted, preferred are materials such as stainless and resin containing glass fiber which scarcely show decrease of mechanical strength or deformation by exposing to heat.

The support obtained in the above manner generally has a width of not less than 1 m, preferably 1 to 5 m, more preferably 1.2 to 5 m and especially 1.35 to 5 m. The film support generally has a length of not less than 1,000 m, preferably 1,000 to 5,000 m, more preferably 2,000 to 5,000 m and especially 2,500 to 5,000 m.

The support generally has a thickness of 60 to 100 μm, preferably 80 to 100 μm, and more preferably 85 to 95 μm. In the case of a thickness of less than 60 μm, such a thin support is not capable of relaxing the shrinkage stress of the photographic layer during drying. In the case of a thickness of more than 100 μm, such a thick support is against to the object of reducing a thickness of the support to give a compact-sized patrone or camera.

The film support of the invention has generally a surface roughness of 0.0015 to 0.050 μm, preferably 0.0020 to 0.050 μm, more preferably 0.0025 to 0.050 μm and most preferably 0.0030 to 0.050 μm. The support having the surface roughness exhibits an improved lubricative property (lubricity) and bonding strength between the support and the photographic layer (or the subbing layer or the backing layer).

Further, the support generally has haze of not more than 3%, preferably not more than 2%, and more preferably not more than 1.5%. The haze of more than 3% brings about reduction of the sharpness of the resultant photographic image.

The support having the surface roughness and the above haze is advantageously prepared by introducing fine particles such as silica, silicone paticles and crosslinked polystyrene beads into the support as mentioned later. Silica is preferred.

Further, the support generally has a friction coefficient between the supports of not less than 0.6, preferably not less than 0.7, and more preferably not less than 0.75. When the friction coefficient less than 0.6, the support is damaged due to slipping during a rolling procedure. Further, the continuous film (support) is apt to slip in a winding procedure to slide off location to be wound.

The support generally contains various additives in order to render suitable for a support for a photographic material.

The support is preferably treated to have lubricative property. The methods for making such film, for instance, include a method of kneading an inactive inorganic compound or a polymer into the polymer film or a method of coating a surfactant over the film.

Preferred examples of the inactive inorganic compound or polymer include $SiO_2$ (silica), silicone and crosslinked polystyrene. For example (in the case of polymer of polyester), in addition to the above method of adding the inactive grains to the polyester for making the film lubricant, also employable is another method of precipitating the catalyst, which is to be added to the polymerization reaction system of producing polyester, in the resultant polyester film so as to make the film lubricative due to precipitation of the internal grains.

The support of the photographic sheet generally is transparent, and therefore as means for making the polymer film lubricative, it is preferred to adopt the former method in the case of adding $SiO_2$, silicone or crosslinked polystyrene which have a reflective index near to that of the polyester as mentioned above, or the latter method that enables the size of the grains precipitated in the polyester film to reduce.

The support preferably contains fine particles to improve lubricative property and bonding strength between the support and the photographic layer. Therefore the support has a large number of projections on its surface. The projections are formed by dispersing a large number of the fine particles (preferably having spherical shape). The fine particles generally are silica particles, silicone particles or crosslinked polystyrene beads. Preferred is silica. The polyester containing the fine particles such as silica particles is prepared by adding the particles to the polyester during esterification reaction such as transesterification or polyesterification reaction of a transesterification method, or polyesterification reaction of a direct polymerization method. It is preferred to add the particles to the polyester reaction system at an initial stage such as a period until the intrinsic viscosity of the system comes to approx. 0.3.

The silica particle employed for the invention generally has a volume-shape coefficient (f) of 0.2 to π/6. The volume-shape coefficient (f) is represented by the following formula:

$$f=V/D^3$$

in which V is a mean volume ($\mu m^3$) per a particle and D is a mean value of maximum particle sizes. D (the mean value of maximum particle sizes) means the mean of maxima of a distance of a straight line across the particle. The volume-shape coefficient (f) preferably is in the range of 0.3 to π/6, and more preferably in the range of 0.4 to π/6. The silica particle has a real spherical shape in the case of f of π/6. The use of the particle having f of less than 0.2 does not bring about the desired surface characteristics.

The silica particle generally has a ratio of particle sizes (ratio of a major axis to a minor axis) of 1.0 to 1.2, preferably 1.0 to 1.15 and more preferably 1.0 to 1.1. The fine particle generally has a mean particle size of 0.03 to 2.5 μm, preferably 0.05 to 1.0 μm and more preferably 0.1 to 0.8 μm. The spherical silica having such dimensions differs from the known silica particles of 10 nm or the known aggregate of 0.5 μm formed by the aggregation of the silica particles.

The use of the silica particle having a particle size of less than 0.03 μm does not result in the good lubricant properties. In the case of using the silica particle having a particle size of more than 3 μm, the resultant support shows increase of haze and reduction of scratch hardness due to higher projections formed on the support.

The silica particle size (diameter of the circle having the same area as that of the particle), the major axis and the minor axis are measured by observing an image obtained by magnifying the metal-deposited surface of the particle 10,000 to 30,000 times by a microscope. Then, the mean particle size and the ratio of the major axis to the minor axis is determined according the following formulae:

$$\text{Mean particle size} = \frac{\text{Total lengths of diameters}}{\text{Number of the measured particles}}$$

$$\text{Ratio of particle sizes} = \frac{\text{Mean major axis}}{\text{Mean minor axis}}$$

The distribution of the particle size preferably has a steep curve. The distribution preferably has relative standard deviation of the particle size (which shows degree of the steep curve) of not more than 0.5, more preferably not more than 0.4 and most preferably not more than 0.3.

The relative standard deviation is represented by the following formulae:

$$\text{Relative standard deviation} = \frac{\sqrt{\sum_{i=1}^{n} \frac{(Di - Da)^2}{n}}}{Da}$$

in which Di stands for the diameter of the circle having the same area as that of each particle and Da stands for the mean value of the particle sizes;

$$Da = \frac{\sum_{i=1}^{n} Di}{n}$$

in which n is the number of the particles.

In the case that the spherical particle (preferably silica particle) having the relative standard deviation of not more than 0.5 is added to poly(ethylene-2,6-naphthalate), uniform projections (in which all heights of the projections are almost equal one another) are formed the surface of poly (ethylene-2,6-naphthalate) film. Therefore, the support having such surface shows a good lubricative property.

Various silica particles can be employed in the invention without any restriction with regard to its preparation and the like, so long as it satisfies the above-mentioned conditions.

The particle is generally contained in the amount of 0.001 to 0.8 weight %, preferably contained in the amount of 0.005 to 0.6 weight %, and more preferably contained in the amount of 0.01 to 0.5 weight %, based on the weight of the polymer.

In the invention, the support may contain inactive inorganic particles other than the above particles or those which have no particle sizes thereof in combination with the above particles. Examples of the inactive inorganic particles include a) $SiO_2$; b) alumina; c) silicates containing $SiO_2$ in the amount of 30 or more weight % such as amorphous crystalline clay or mineral, aluminum silicate (including burned product or hydrate thereof), chrysotile, zircon and fly ash; d) oxides of Hg, Zn, Zr and Ti; e) sulfates of Ca and Ba; f) phosphates of Li, Ba and Ca (including primary and secondary phosphates); g) benzonates of Li, Na and K; terephthalates of Ca, Ba, Zn and Hn; i) titanates of Mg, Ca, Ba, Zn, Cd, Pb, Sr, Hn, Fe, Co and Ni; j) chromates of Ba and Pb; k) carbons such as carbon black and graphite; l) glasses such as glass powder and glass bead; m) carbonates of Ca and Mg; n) fluorite; and o) ZnS. Preferred are silica, silicate, aluminum oxide, aluminum silicate, lithium dihydrogen phosphate, lithium phosphate, sodium phosphate, calcium phosphate, barium sulfate, titanium dioxide, lithium benzonate, and double salt thereof; and glass powder, clay (including kaolin, bentonite and china clay), talc, diatomaceous earth and calcium carbonate. Particularly preferred are silica and calcium carbonate.

In the invention, it is preferred that the silica particle, silicone particle and crosslinked styrene particle are employed as particle having a relatively large size and a deposited particle produced during preparation of polyester, which scarcely produces void, is employed in combination with the particle. The support containing these particles shows an enhanced transparency and improved wind-up property.

The deposited particle is, for example, formed by adding a compound containing phosphorus to reaction system of polyester containing the above inactive inorganic compound. Examples of the compounds containing phosphorus include phosphoric acid, phosphorous acid and esters thereof such as alkyl ester and aryl ester. Further, other additives such as lithium phosphate may be introduced into the polyester for the purpose of acceleration of the formation of deposited particle, control of particle size of deposited particle and stabilization of the resultant deposited particle. The deposited particles containing calcium, lithium and phosphorus have a relatively large particle size and the deposited particles containing lithium and phosphorus have a relatively small particle size. Hence, the composition of the deposited particle is appropriately determined depending upon the desired particle size. Preferred is the composition containing lithium of 0.03 to 5 weight %, calcium of 0.03 to 5 weight % and phosphorus of 0.03 to 10 weight %.

The deposited particle generally has a mean particle size of 0.01 to 2.5 μm, preferably 0.05 to 2.0 μm, more preferably 0.1 to 1.5 μm, and most preferably 0.1 to 1.0 μm. The use of the particles of less than 0.01 μm does not show a satisfactory lubricant property and prevention of occurrence of white powder from the film, and the use of the particles of more than 2.5 μm promotes occurrence of white powder. The support preferably contains the deposited powder in the amount of 0.005 to 2.0 weight % based on the weight of the polyester, more preferably 0.01 to 0.5 weight % and most preferably 0.05 to 0.3 weight %. The use of the particles of less than 0.005 weight % does not show a satisfactory lubricative property, and the use of the particles of more than 2.0 weight % impairs evenness of the surface of the support.

Further, the deposited particle may be contain a slight amount of other metal such as Zn, Mn, Mg, Co, Sb, Ge and Ti so long as the metals do not inhibited the effect of the deposited particle.

The use of a polyester film as a support of a photographic sheet brings about occurrence of light-piping (i.e., edge fog) due to its high refractive index. Polyesters, particularly aromatic polyesters, have a high reflective index of 1.6 to 1.7, while gelatin, which is the essential component of a light-sensitive layer to be coated over the polyester support, has a lower refractive index of 1.50 to 1.55. Therefore, when light is incident upon the edge of such photographic film, it easily reflects on the interface between the support and the light-sensitive layer. The reflection results in a light-piping phenomenon.

In order to improve such light-piping and shading from light, dyes and pigments, which dose not noticeably increase the film haze, is preferably added into the polyester.

The dye may be employed singly or in combination. In practice, it is preferred that two or more dyes are employed to have a color of neutral gray. Examples of the dyes include dyes for polyester such as Diaresin available from Mitsubishi Chemical Industries, Ltd. and Kayaset available from Nippon Kayaku Co., Ltd. The dye is preferably added to the polyester in the increasing amount of a transmission density of not less than 0.01 and particularly preferably in the increasing amount of a transmission density of not less than 0.03.

The polymer film (for the support) may contain various additives to enhance the characteristics required for a photographic support.

The polymer film may contain an ultraviolet absorbent for the purpose of anti-fluorescence and of stabilization in storage, by kneading the absorbent into the film. As the ultraviolet absorbent, preferred are those having no absorption in the visible region. The amount of the absorbent generally is in the range of 0.01 to 20 weight %, and preferably is in the range of 0.05 to 10 weight %, based on the weight of the polyester. Examples of the ultraviolet absorbent include benzophenone compounds such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone and 2,2'-dihydroxy-4,4'-dimethoxybenzophenone; benzotriazole compounds such as 2-(2'-hydroxy-5-methylphenyl) benzotriazole, 2-(2'-hydroxy-3',5'-di-t-butylphenyl) benzotriazole and 2-(2'-hydroxy-3'-di-t-butyl-5'-methylphenyl)benzotriazole; and salicylic acid compounds such as phenyl salicylate and methyl salicylate.

In the case that the particles is introduced into the polymer film by kneading, it is preferred to further laminate a functional layer on the film to more enhance the transparency of the film. Examples of the laminating methods include co-extrusion with plural extruders and feed blocks, and co-extrusion with multi-manifold dies.

Subsequently, on the continuous support such as the polyester film prepared in the above manner, one or more subbing layer (mentioned later) is formed.

One or more subbing layer (mentioned later) is formed by coating on the continuous support which is fed from a film roll, while the coated support is wound in the form of roll. Then, one or more silver halide emulsion layer (mentioned later) is formed by coating on the support having the subbing layer while the coated support is also wound in the form of roll. In this case, the support on which the silver halide emulsion layer has been formed is generally wounded at initial tension of 30 to 100 kg/m and final tension of 30 to 100 kg/m. The initial tension preferably is in the range of 40 to 90 kg/m, especially in the range of 50 to 80 kg/m. The high tension brings about fog by pressure, and the low tension gives loose winding. The winding may be performed with keeping tension unchanged or with increasing or decreasing tension. The winding is preferably performed with decreasing tension.

Wind up speed of the winding generally is in the range of 10 to 350 m/min., preferably in the range of 50 to 300 m/min., and especially 100 to 250 m/min.

The support of a polyester film of the invention has a hydrophobic surface, and therefore it is difficult to firmly bond a photographic layer (e.g., a light-sensitive silver halide emulsion layer, an intermediate layer and a filter layer) or a subbing layer comprising a protective colloid mainly containing gelatin on the support.

Two processes are available as a conventional technique which has been tried to overcome the above difficulty:

(1) a process in which after providing a surface activation treatment such as a chemical treatment, a mechanical treatment, a corona discharge treatment, a flame treatment, a UV treatment, a high frequency wave treatment, a glow discharge treatment, an active plasma treatment, and an ozone oxidation treatment, a subbing layer is formed directly on the above-treated support by coating to obtain a high bonding strength and then a light-sensitive layer is formed on the subbing layer to obtain a high bonding strength; and (2) a process in which a subbing layer is provided without the surface treatment by coating, and then a light-sensitive layer is formed thereon.

These processes are described in U.S. Pat. Nos. 2,698,241, 2,764,520, 2,864,755, 3,462,335, 3,475,193, 3,143,421, 3,501,301, 3,460,994 and 3,674,531, British Patents No. 788,365, No. 804,005 and No. 891,469, and Japanese Patent Publications No. 48(1973)-43122 and No. 51(1976)-446.

It is assumed that any of these surface treatments is effected by forming some polar groups on a surface of a support which is originally hydrophobic and by increasing a cross linking density on a surface, and as a result, it is considered that the affinity of the components contained in a subbing layer with the polar group is increased or the bonding strength between the subbing layer and the support is enhanced. Further, various devices are given to the constitution of the subbing layer. There are a multi-layer process in which a layer bonding strongly to a support (hereinafter referred to as the first subbing layer) is provided as the first layer and a hydrophilic resin layer bonding strongly to a photographic layer is provided thereon as the second layer, and a single layer process in which only a resin layer containing both a hydrophobic group and a hydrophilic group is coated over a support.

Of the surface treatments described in above (1), the corona discharge treatment is the most known process. The treatment can be performed by the processes described in Japanese Patent Publications No. 48(1973)-5043, No. 47(1972)-51905, No. 47(1972)-28067, No. 49(1974)-83767, No. 51(1976)-41770 and No. 51(1976)-131576. A discharge frequency is generally 50 Hz to 5,000 kHz and preferably 5 to 100 kHz. The discharge frequency lower than 50 Hz does not bring about a stable discharge unfavorably generate a pin hole on a material to be treated. In contrast, the frequency higher than 5,000 kHz requires a specific equipment for matching impedance and unfavorably increases the cost of the machine. The treatment strength preferably is 0.001 to 5 kV·A·minute/$m^2$, more preferably 0.01 to 1 kV·A·minute/$m^2$ for the improvement in a wetting property of a plastic film such as polyester or polyolefin. A gap clearance between an electrode and a dielectric roll generally is in the range of 0.5 to 2.5 mm, and preferably in the range of 1.0 to 2.0 mm.

Further, the glow discharge treatment is the surface treatment which is most effective in many case. The process is described in Japanese Patent Publications No. 35(1960)-7578, No. 36(1961)-10336, No. 45(1970)-22004, No. 45(1970)-22005, No. 45(1970)-224040 and No. 46(1971)-43480, U.S. Pat. Nos. 3,057,792, 3,057,795, 3,179,482, 3,288,638, 3,309,299, 3,424,735, 3,462,335, 3,475,307 and 3,761,299, British Patents No. 997,093 and Japanese Patent Provisional Publication No. 53(1978)-129262.

With respect to the glow discharge treatment conditions, pressure generally is in the range of 0.005 to 20 Torr, and more preferably in the range of 0.02 to 2 Torr. The pressure lower than 0.02 reduces an effect of the surface treatment and the pressure higher than 20 Torr allows an excessive current to flow and therefore a spark is apt to produce. Discharge is generated by loading a high voltage between one or more pair of metal plates or metal rods arranged at the interval in a vacuum tank. This voltage has various depending on variation of a composition and pressure of an environmental gas. A stable and steady glow discharge usually takes place between 500 to 5,000 V in the above pressure range. The range of the voltage particularly suitable for improving a bonding strength is 2,000 to 4,000 V.

A discharge frequency preferably is in the range of 0 (i.e., a direct current) to several thousand MHz and more preferably in the range of 50 Hz to 20 MHz. The strength of a discharge treatment preferably is in the range of 0.01 to 5 kV·A·minute/$m^2$ and more preferably in the range of 0.15 to 1 kV·A·minute/$m^2$ because of obtaining a desired bonding strength.

The UV treatment (UV (ultra-violet) light irradiation treatment) is performed according to the known methods described in Japanese Patent Publications No. 41(1966)-10385, No. 43(1968)-2603, No. 43(1968)-2604 and No. 45(1970)-3828. A high pressure mercury vapor lamp of a main wavelength of 365 nm is generally used as the light source so long as it is accepted that the surface temperature of the support is raised to about 150° C. When irradiation under low temperature is needed, use of a low pressure mercury vapor lamp of amain wavelength of 254 nm is preferred. A high or low pressure mercury vapor lamp of ozone-free type (type producing no ozone) can be employed. The more amount of a light for the treatment improves bonding strength between the support and the layer to be provided thereon, but increases coloration and brittleness of the support.

In the invention, the amount of a light generally is 20 to 10,000 mJ/cm$^2$ in the case of using the high pressure mercury vapor lamp of a main wavelength of 365 nm, and preferably 50 to 2,000 mJ/cm$^2$. The amount of a light generally is 100 to 10,000 mJ/cm$^2$ in the case of using the low pressure mercury vapor lamp of a main wavelength of 365 nm, and preferably 300 to 1,500 mJ/cm$^2$.

Previously heating of the film depresses coloration to some extent. For examples, poly(ethylene-2,6-naphthalate) is preferably heated to temperature of not higher than 190° C. Further, from the viewpoint of Tg (120° C.) and the bonding strength, it is preferred that the treatment is conducted in the range of 85° to 120° C.

The surface of the support can be heated in vacuo by the use of an infra-red heater or in contact with heat-roll. When the surface of the support is needed to raise to 100° C., the surface is in contact with the heat-roll heated at 100° C. only for 1 second to attain a temperature of 100° C.

Subsequently, the surface treatment described in (2) above is described. Examples of known materials for the first subbing layer in the multi-layer process include copolymers derived from vinyl chloride, vinylidene chloride, butadiene, methacrylic acid, acrylic acid, itaconic acid and maleic anhydride; polyethyleneimine; an epoxy resin; a grafted gelatin; nitrocellulose; halogen-containing resin such as polyvinyl bromide, polyvinyl fluoride, polyvinyl acetate, chlorinated polyethylene, chlorinated polypropylene, bromated polyethylene, chlorinated rubber, vinyl chloride/ethylene copolymer, vinyl chloride/propylene copolymer, vinyl chloride/styrene copolymer, isobutylene chloride containing copolymer, vinyl chloride/vinylidene chloride copolymer, vinyl chloride/styrene/maleic anhydride copolymer, vinyl chloride/styrene/acrylonitrile copolymer, vinyl chloride/butadiene copolymer, vinyl chloride/isoprene copolymer, vinyl chloride/chlorinated propylene copolymer, vinyl chloride/vinylidene chloride/vinyl acetate copolymer, vinyl chloride/acrylic acid ester copolymer, vinyl chloride/maleic acid ester copolymer, vinyl chloride/methacrylic acid ester copolymer, vinyl chloride/acrylonitrile copolymer, internally plasticized poly(vinyl chloride), vinyl chloride/vinyl acetate copolymer, poly(vinylidene chloride), vinylidene chloride/methacrylic acid ester copolymer, vinylidene chloride/acrylonitrile copolymer, vinylidene chloride/acrylic acid ester copolymer, chloroethyl vinyl ether/acrylic acid ester copolymer and polychloroprene; α-olefin polymers such as polyethylene, polypropylene, polybutene, poly-3-methylbutene and poly-1,2-butadiene; copolymers such as ethylene/propylene copolymer, ethylene/vinyl ether copolymer, ethylene/propylene/1,4-hexadiene copolymer, ethylene/vinyl acetate copolymer, butadiene/propylene copolymer and butadiene/acrylonitrile copolymer, and blends of these copolymers and halogen-containing resins; acrylic resin such as methyl acrylate/acrylonitrile copolymer, ethyl acrylate/styrene copolymer, methyl methacrylate/acrylonitrile copolymer, poly(methyl methacrylate), methyl methacrylate/styrene copolymer, butyl methacrylate/styrene copolymer, polymethyl acrylate, polymethyl-α-chloroacrylate, polymethoxyethyl acrylate, polyglycidylacrylate, polybutyl acrylate, polymethyl acrylate, polyethyl acrylate, acrylic acid/butyl acrylate copolymer, acrylic acid ester/butadiene/styrene copolymer and methacrylic acid ester/butadiene/styrene copolymer; styrene containing resins such as polystyrene, poly-α-methylstyrene, styrene/dimethylfumarate copolymer, styrene/maleic anhydride copolymer, styrene/butadiene copolymer, styrene/butadiene/acrylonitrile copolymer, poly (2,6-dimethylphenleneoxide) and styrene/acrylonitrile copolymer; polyvinyl carbazole; poly(p-xylylene); polyvinyl formal; polyvinyl acetal; polyvinyl butyral; polyvinyl phthalate; cellulose triacetate; cellulose butyrate; cellulose phthalate; nylon 6; nylon 66; nylon 12; methoxymethyl-6-nylon; nylon-6,10-polycapramide; poly-N-butyl-nylon-6-polyethylene sebacate; polybutylene glutarate; polyhexamethylene adipate; polybutylene isophthalate; polyethylene terephthalate; polyethylene adipate; polyethylene adipate isophthalate; polyethylene-2,6-naphthalate; polydiethylene glycol terephthalate; polyethyleneoxybenzoate; bisphenol A isophthalate; polyacrylonitrile; biphenol A adipate; polyhexamethylene-m-benzenesulfoneamide; polytetramethylenehexamethylene carbonate; polydimethyl siloxane; polyethylene methylene-bis-4-phenylene carbonate; and bisphenol A polycarbonate (described in, for example E,. H. Immergut "Polymer Handbook", Vol. IV. pages 187–231, Interscience Pub. New York, 1988).

An example of a known material for the second subbing layer is gelatin.

In the single layer process, a support is swollen and is subjected to an internal mixing with a hydrophilic polymer for the subbing layer to obtain a high bonding strength in many cases. Examples of materials for the subbing layer include a water soluble polymer, cellulose ester, a latex polymer and a water soluble polyester. Examples of materials for the water soluble polymer include gelatin, gelatin-derivatives, casein, agar, sodium alginate, starch, polyvinyl alcohol, an acrylic acid-containing copolymer and a maleic anhydride-containing copolymer. Examples of materials for the cellulose ester include carboxymethyl cellulose and hydroxyethyl cellulose. Examples of materials for the latex polymer include a vinyl chloride-containing copolymer, a vinylidene chloride-containing copolymer, an acrylic acid ester-containing copolymer, a vinyl acetate-containing copolymer and a butadiene-containing copolymer. Gelatin particularly is preferred.

Examples of the compounds which swell the support include resorcin, chlororesorcin, methylresorcin, o-cresol, m-cresol, p-cresol, phenol, o-chlorophenol, p-chlorophenol, dichlorophenol, trichlorophenol, monochloroacetic acid, dichloroacetic acid, trifluoroacetic acid and chloral hydrate. Preferred are resorcin and p-chlorophenol.

Various gelatin hardeners can be employed for the subbing layer.

Examples of the gelatin hardeners include a chromium salt (e.g., chrome alum), aldehydes (e.g., formaldehyde and glutaraldehyde), isocyanates, an active halogen compound (e.g., 2,4-dichloro-6-hydroxy-s-triazine), an epichlorohydrin resin, cyanuric acid chloride compound, a vinyl sulfone or sulfonyl compound, a carbamoyl ammonium chloride compound, amidinium salt compound, a carbodiimide compound and pyridinium salt compound.

The subbing layer may contain, as a matting agent, an inorganic fine particle such as $SiO_2$, $TiO_2$, calciume carbonate or magnesium carbonate, or a fine particle of a polymer such as polymethyl methacrylate copolymer, celullose acetate propionate or polystyrene. The diameter of the matting agent preferably is in the range of 0.01 to 10 μm.

Further, a coating solution for forming the subbing layer may contain various additives other than the above compounds. For instance, examples of the additives include a surface active agent, an antistatic agent, an antihalation agent, a coloring dye, a pigment, a coating aid and an antifogging agent.

The coating solution for the subbing layer can be coated by known coating methods such as a dip coating method, a roller coating method, a curtain coating method, an air knife coating method, a wire bar coating method, a gravure coating method or an extrusion coating method using a hopper described in U.S. Pat. No. 2,681,294. Two or more layers can be simultaneously be coated according to the processes described in U.S. Pat. Nos. 2,761,791, 3,508,947, 2,941,898 and 3,526,528.

The backing layer can employ, as a binder, a hydrophobic polymer or a hydrophilic polymer as used for the subbing layer.

The backing layer may contain an antistatic agent, a sliding agent, a matting agent, a surface active agent and a dye. Examples of the antistatic agent include anionic polymer electrolytes such as polymers containing carboxylic acid, carboxylic acid salt and sulfonic acid salt described in Japanese Patent Provisional Publications No. 48(1973)-22017, No. 51(1976)-30725, No. 51(1976)-129216 and No. 55(1980)-95942, and Japanese Patent Publication No. 46(1971)-24159; and cationic polymers described in Japanese Patent Provisional Publications No. 49(1974)-121523 and No. 48(1973)-91165, and Japanese Patent Publication No. 49(1974)-24582. Examples of the surface active agent include anionic or cationic surface active agents described in U.S. Pat. Nos. 2,992,108 and 3,206,312, Japanese Patent Provisional Publications No. 49(1974)-85826, No. 49(1974)-33630, No. 48(1973)-87862 and No. 55(1980)-70837, and Japanese Patent Publications No. 49(1974)-11567 and No. 49(1974)-11536.

The antistatic agent of the backing layer preferably is the fine particle of at least one crystalline metal oxide selected from ZnO, $TiO_2$, $SnO_2$, $Al_2O_3$, $In_2O_2$, $SiO_2$, MgO, BaO, $MoO_3$ and $V_2O$, or a composite metal oxide thereof. The volume resistivity of the crystalline metal oxide or composite metal oxide thereof preferably is not more than $10^7$ Ωcm, and more preferably not more than $10^5$ Ωcm. The particle size of the oxide preferably is 0.002 to 0.7 μm, and more preferably 0.005 to 0.3 μm. Use of the fine particle is preferred from the viewpoint of prevention of occurrence of static mark.

A diameter of the spool of the cartridge (patrone) around which a photographic film obtained from the photographic sheet of the invention can be wounded generally is in the range of 3 to 12 mm. The film having the diameter less than 3 mm reduces the photographic characteristics of a light-sensitive layer and other layers due to pressure caused by bending stress of the film. Further, the diameter of photographic film preferably is in the range of 3 to 10 mm, and more preferably is in the range of 4 to 8 mm.

The silver halide emulsion layer of the continuous silver halide photographic sheet of the invention is described below.

The silver halide emulsion layer (silver halide photographic layer) may be used for either a black and white photographic material or a color photographic material. The silver halide emulsion layer for color photographic sheet is described below.

The color photographic sheet may have at least one of layers consisting of a red-sensitive emulsion layer, a green-sensitive emulsion layer and a blue-sensitive emulsion layer on the support. The arrangement of those layers can be optionally determined. As a typical example, there can be mentioned silver halide photographic material provided with at least one sensitive layer consisting of plural silver halide emulsion layers (which are substantially same each other in sensitivity), and the sensitive layer is a red-sensitive layer, a green sensitive layer or a blue sensitive layer. In a multi-layered silver halide color photographic material, generally, the red-sensitive layer, the green sensitive layer and the blue sensitive layer are arranged from the support side in this order. The blue-sensitive layer, the green-sensitive layer and the red-sensitive layer may be arranged in this order from the support side. Further, the blue-sensitive layer, the red-sensitive layer and the green-sensitive layer may be arranged in this order from the support side. Further, two or more emulsion layers which are sensitive to the same color but show different sensitivities can be provided to enhance the sensitivity. Three emulsion layers can be provided to improve the graininess of the image. A non-light sensitive layer such as an intermediate layer may be interposed between two or more emulsion layers having the same color sensitivity.

The intermediate layer may contain couplers or DIR compounds.

The plural silver halide emulsion layers constituting each unit light sensitive layer are described in West Germany Patent No. 1,121,470 and in U.K. Patent No. 923,045.

Silver halide grains may be regular grains having a regular crystal shape such as a cube, octahedron or tetradecahedron, those having an irregular shape such as sphere or tablet, those having a crystal defect such as twinning plane, or those having a combination of the shapes.

The silver halide grains may be either fine grains of not more than about 0.2 μm in the diameter or giant grains having a projected area diameter or up to about 20 μm. The emulsion may be either a monodisperse emulsion or a poly-disperse emulsion.

A photographic emulsion can be prepared in accordance with a method described in Research Disclosure No. 17643 (December 1978), pp. 22–23, "I. Emulsion Preparation and Types", and ibid. No. 18716 (November 1979), page 648, "Chimie et Physique Photographique" by P. Glafkides, Paul Montel, 1967; "Photographic Emulsion Chemistry" by G. F. Duffin, Focal Press, 1966; or "Making and Coating Photographic Emulsion" by V. L. Zelikman et al., Focal Press, 1964).

Further, monodisperse emulsions as described in U.S. Pat. Nos. 3,574,628 and 3,655,394, and U.K. Patent 1,413,748 is also preferred.

A tabular silver halide grain having an aspect ratio of not less than 5 can also be employed in the invention. A tabular silver halide grain can be easily prepared in accordance with methods described in "Photographic Science and Engineering" by Gutoff, vol. 14 (1970), pp. 248–257; U.S. Pat. Nos. 4,434,226, 4,414,310, 4,433,048, 4,439,520 and U.K. Patent No. 2,112,157.

The crystal structure may be either homogeneous or heterogeneous. In the heterogeneous structure, the halogen compositions positioned inside and outside are different each other. The crystalline may be of a layered structure. Some silver halides in which halogens are different each other may connect by epitaxial bond to form the crystal, or a salt other than silver halide such as silver rhodanite and lead oxide also may connect to the silver halide crystal by epitaxial bond. Mixture of grains having various crystal shapes also may be employed.

The silver halide emulsion layer of the invention generally has sensitivity of not less than 100 which is based upon International Organization for Standardization. The sensitivity preferably is not less than 200, especially not less than 320. The silver halide emulsion layer generally contains silver halide grains in the form of flat plate. The mean particle size of the particles preferably is in the range of 0.3 to 3.0 μm, especially 0.5 to 1.5 μm.

The silver halide grains in the form of flat plate generally have aspect ratio (mean diameter/mean thickness) of not less than 2.0, preferably aspect ratio of 2.5 to 20, and especially aspect ratio of 3.0 to 10. The mean thickness generally is not more than 0.5 μm, preferably not more than 0.3 μm.

The diameter of the silver halide grain is defined as a diameter of circle having the same area as the projected area of the grain which is obtained by observation of the particle using an electron microscope. The thickness of the silver halide grain is defined as the minimum, which is determined by measuring all distances therebetween as to all combinations of two planes parallel each other constituting the grain and finding the minimum of the distances. The measurement is performed by observation of an electron micrograph having shadows of silver halide grains or an electron micrograph of section of a sample obtained by forming photographic layer on the support.

The aspect ratio is determined by measuring diameters and thicknesses of 100 or more samples. In the invention, the silver halide grains in the form of flat plate having aspect ratio of not less than 2.0 preferably forms an amount corresponding to not less than 30% of a total projected area of all silver halide grains, especially forms an amount corresponding to not less than 50% of the total projected area.

The silver halide grains in the form of flat plate preferably has monodisperse property.

The composition of silver halide of the silver halide emulsion layer may comprise silver chloride, silver bromide, silver chlorobromide, silver iodobromide and silver chlorobromide iodide in any ratio. Silver bromide or silver iodobromide is preferred in terms of high sensitivity. Mean content of silver iodide is preferably in the amount of not more than 5.0 molar %, especially of 0.1 to 3.0 molar %.

The emulsion used in the invention is usually subject to physical ripening, chemical ripening and spectral sensitization. Additives used in these process are described in Research Disclosure No. 17643 (December, 1978) and ibid., No. 18716 (November, 1979). The pages in which the additives are described are set forth below.

Known photographic additives used in the invention are also described in the above two Research Disclosures. The pages are also set forth below.

| | Additives | R.D. No. 17643 | R.D. No. 18716 |
|---|---|---|---|
| 1. | Chemical Sensitizer | pp. 23 | pp. 648, right column |
| 2. | Sensitivity Promoter | | same as above |
| 3. | Spectral Sensitizer, Supersensitizer | pp. 23–24 | pp. 648, right column - 649, left column |
| 4. | Brightening Agent | pp. 24 | |
| 5. | Antifogging Agent and Stabilizer | pp. 24–25 | pp. 649, right column |
| 6. | Light Absorber, Filter Dye, and U.V. Absorber | pp. 25–26 | pp. 649, right column - 650, left column |
| 7. | Color Stain Inhibitor | pp. 25, right | pp. 650, left column - right column |
| 8. | Dye Image Stabilizer | pp. 25 | |
| 9. | Hardening Agent | pp. 26 | pp. 651, left column |

-continued

| | Additives | R.D. No. 17643 | R.D. No. 18716 |
|---|---|---|---|
| 10. | Binder | pp. 26 | same as above |
| 11. | Plasticizer, Lubricant | pp. 27 | pp. 650, right column |
| 12. | Coating Aid, and Surface Active Agent | pp. 26–27 | same as above |
| 13. | Antistatic Agent | pp. 27 | same as above |

To inhibit deterioration in photographic properties caused by formaldehyde gas, a compound capable of reacting with and solidifying formaldehyde as disclosed in U.S. Pat. Nos. 4,411,987 and 4,435,503 can be preferably incorporated into the light sensitive material.

Various color couplers can be used for the invention. Concrete examples of the couplers are described in the patents cited in Research Disclosure No. 17643, VII C-G.

As a yellow coupler, preferred are those described in, for example, U.S. Pat. Nos. 3,933,501, 3,973,968, 4,022,620, 4,326,024, 4,401,752, 4,248,961, 4,314,023 and 4,511,649, Japanese Patent Publication No. 58(1983)-10739, U.K. Patents No. 1,425,020 and No. 1,476,760, and European Patent No. 249,473A.

As magenta couplers, 5-pyrazolone type and pyrazoloazole type compounds are preferred, and particularly preferred are those described in U.S. Pat. Nos. 4,310,619 and 4,351,897, European Patent No. 73,636, U.S. Pat. Nos. 3,061,432 and 3,725,067, Research Disclosure No. 24220 (June, 1984), Japanese Patent Provisional Publication No. 60(1985)-33552, Research Disclosure No. 24230 (June, 1984), U.S. Pat. Nos. 4,500,630, 4,540,654 and 4,556,630, and WO(PCT)88/04795.

As cyan couplers, there can be mentioned phenol type and naphthol type couplers, and preferred examples are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Publication No. 3,329,729, European Patents No. 121,365A and No. 249,453A, and U.S. Pat. Nos. 3,446,622, 4,333,999, 4,753,871, 4,451,559, 4,427,767, 4,690,889, 4,254,212 and 4,296,199.

A colored coupler may be used to compensate incidental absorption of a formed dye. The colored coupler is described in Research Disclosure No. 17643, VII-G, U.S. Pat. Nos. 4,163,670, 4,004,929 and 4,138,258, and U.K. Patent No. 1,146,368.

As couplers which give a color developing dye exhibiting a proper diffusion, preferred are those described in U.S. Pat. No. 4,366,237, U.K. Patent No. 2,125,570, European Patent No. 96,570, and West German Patent Publication No. 3,234,533.

Typical examples of polymerized dye-forming couplers are described in U.S. Pat. Nos. 3,451,820, 4,080,211, 4,367,282, 4,409,320 and 4,576,910, and U.K. Patent No. 2,102,173.

A coupler which releases a photographically useful residue in accordance with a coupling reaction can be also used in the invention. A DIR coupler which releases a development inhibitor is employable. The DIR coupler is described in Research Disclosure No. 17643, VII-F and U.S. Pat. No. 4,248,962.

A coupler which imagewise releases a nucleating agent or a development accelerator in a development process is also available. This coupler is described in U.K. Patents No. 2,097,140 and No. 2,131,188.

Examples of other couplers employable for the photographic material of the invention include a competing coupler, a polyvalent coupler, a DIR redox compound-releasing coupler, a DIR coupler-releasing coupler, a DIR coupler-releasing redox compound, a DIR redox-releasing redox compound, a coupler which releases a dye having restoration to original color after an elimination reaction, a bleach accelerator-releasing coupler and a coupler which releases ligand.

The couplers can be introduced into the photographic material by various known dispersing methods.

Examples of a high-boiling solvent used in an O/W dispersing method are described in U.S. Pat. No. 2,322,027.

Examples of the high-boiling organic solvent having a boiling point of not lower than 175° C. under a normal pressure used in the O/W dispersing method include phthalates (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl) isophthalate, bis(1,1-diethylpropyl)phthalate); esters of phosphoric acid or phosphoric acid (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate); benzoates (e.g., 2-ethylhexyl benzoate, dodecyl benzoate, 2-ethylhexyl-p-hydroxybenzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic carboxylic esters (e.g., bis(2-ethylhexyl)sebacate, dioctyl azelate, glycerol tributylate, isostearyl lactate, trioctyl citrate); aniline derivatives (e.g., N,N-dibutyl-2-butoxyl-5-tert-octylaniline); and hydrocarbons (e.g., paraffin, dodecyl benzene, diisopropyl naphthalene). An organic solvent having a boiling point of not lower than about 30° C. preferably in the range of 50° C. to about 160° C. can be used as an auxiliary solvent. Examples of the auxiliary solvent include ethyl acetate, butyl acetate, ethyl propionate, methyl ethyl ketone, cyclohexanone, 2-ethoxyethyl acetate and dimethylformamide.

A process of a latex dispersing method, effects thereof and concrete examples of latex for impregnation are described in U.S. Pat. No. 4,199,363, West German Patent Applications (OLS) No. 2,541,274 and No. 2,541,230.

In the photographic material, the total thickness of all hydrophilic colloid layers on the emulsion side is preferably not more than 28 μm. The film swelling rate ($T_{1/2}$) is preferably not more than 30 seconds. The film thickness is determined after being stored at a temperature of 25° C. and a relative humidity of 55% for two days. The film swelling rate ($T_{1/2}$) can be determined by a known method in the art, for example, by using a swellometer of the type as described in A. Green et al, "Photographic Science and Engineering", Vol. 19, No. 2. pp. 124–129. $T_{1/2}$ is defined as the time taken until half the saturated film thickness is 90% of the maximum swollen film thickness reached when the photographic material is processed with a color developer at a temperature of 30° C. over 195 seconds.

In the invention, formation of perforations on the photographic film (silver halide photographic material), for example, is performed according to the methods as described in Japanese Patent Provisional Publications No. 57(1982)-41195, No. 61(1986)-214999, No. 62(1987)-136399, No. 1(1989)-271197, No. 3(1991)-239497 and No. 2(1990)-269598, and Japanese Patent Publications No. 1(1989)-210299. The perforations are formed on one or both side of the photographic film if necessary.

The present invention is further described by the following examples.

EXAMPLES 1–11 AND COMPARISON EXAMPLES 1–3

1) Preparation of the support (a) PET support (dyed gray):

To a commercially available poly(ethylene terephthalate) (homopolymer) having intrinsic viscosity of 0.60 was added 0.005 weight % of spherical silica (mean particle size: 0.3 μm; major axis/minor axis: 1.07) and two dyes of 66 ppm of compound II-5 indicated below and 54 ppm of compound I-6 indicated below, to be mixed and the mixture was dried. The mixture was melted at 300° C. and then extruded from T-die. The extruded film was stretched in a lengthwise direction 3.3 times its original length at 120° C., and stretched in a widthwise direction 3.3 times at 110° C., and then was subjected to heat setting at 240° C. for 6 seconds, whereby the film having the thickness of 90 μm was obtained. The amount of the silica or dyes is based on the amount of the poly(ethylene terephthalate).

The resultant film had transmission density of 0.07 in each of blue filter (B), green filter (G) and red filter (R), which was measured by a densitometer (X-RITE Status M, manufactured by X-RITE Co., Ltd.).

(b) PEN support (dyed gray):

To a commercially available poly(ethylene-2.6-naphthalate) (homopolymer) having intrinsic viscosity of 0.60 was added 0.005 weight % of spherical silica (mean particle size: 0.3 μm; major axis/minor axis: 1.07) and two dyes of 54 ppm of compound I-24 and 54 ppm of compound I-6, to be mixed and the mixture was dried. The mixture was melted at 300° C. and then extruded from T-die. The extruded film was stretched in a lengthwise direction 3.3 times its original length at 140° C., and stretched in a widthwise direction 3.3 times at 130° C., and then was subjected to heat setting at 250° C. for 6 seconds, whereby the film having the thickness of 90 μm was obtained. The amount of the silica or dyes is based on the amount of the poly(ethylene-2.6-naphthalate).

The resultant film had transmission density of 0.07 in each of blue filter (B), green filter (G) and red filter (R), which was measured by X-RITE Status M (manufactured by X-RITE Co., Ltd.).

(c) PEN/PET (=4/1, weight ratio) support (dyed gray):

A commercially available poly(ethylene terephthalate) (homopolymer) having intrinsic viscosity of 0.60 and a commercially available poly(ethylene terephthalate) (homopolymer) having intrinsic viscosity of 0.60 were mixed in a ratio of poly(ethylene terephthalate) and poly (ethylene terephthalate) of 80/20 (weight ratio) to prepare a mixture.

To the mixture was added 0.005 weight % of spherical silica (mean particle size: 0.3 μm; major axis/minor axis: 1.07) and two dyes of 46 ppm of compound I-26 and 66 ppm of compound II-5, to be mixed and the mixture was dried. The mixture was melted at 300° C. and then extruded from T-die. The extruded film was stretched in a lengthwise direction 3.3 times its original length at 140° C., and stretched in a widthwise direction 3.3 times at 130° C., and then was subjected to heat setting at 250° C. for 6 seconds, whereby the film having the thickness of 90 μm was obtained. The amount of the silica or dyes is based on the amount of the blend of polymers.

The resultant film had transmission density of 0.07 in each of blue filter (B), Green filter (G) and red filter (R), which was measured by X-RITE Status M (manufactured by X-RITE Co., Ltd.).

All the films had a width of 1,500 mm and a length of 3,000 m.

The above dyes have the following structures:

II-5

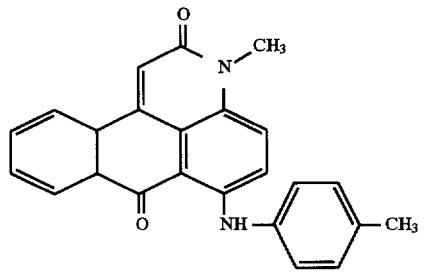

I-6

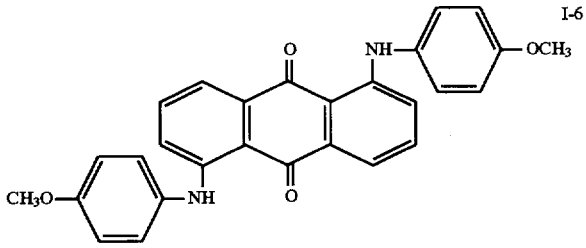

I-24

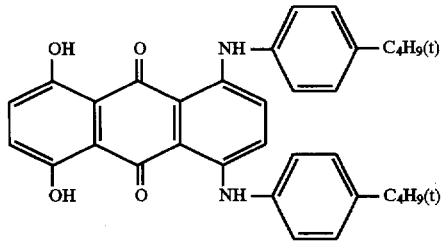

I-26

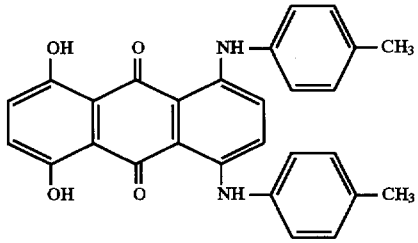

2) Surface treatment of support (film)

[Glow discharge treatment]

Four cylindrical stainless steel rods (electrodes) having a diameter of 2 cm and a length 120 cm were fixed at intervals of 10 cm on an insulating panel. This electrode panel was fixed in a vacuum room. A support sample was fed so as to be subjected to the treatment for 2 seconds at a distance of 15 cm over the surface (panel) of the electrode panel. Just before the treatment, the support was heated to have Tg−5° C. on its surface by bringing contact with a heated roll having a temperature-controller (diameter: 50 cm) which is arranged in a such a manner that the support is contact with ¾ circumference of the roll, the temperature of the support being measured by bringing a thermocouple temperature indicator contact with its surface passing between the heated roll and the electrode panel.

The glow discharge treatment was performed under reduced pressure of 0.2 Torr and partial pressure ($H_2O$) of 75% at discharge frequency of 30 kHz and treatment strength of 0.5 kV·A min./m$^2$. The glow discharged treatment was performed on both surfaces of the support.

The glow discharged support was brought contact with a cooled roll having a temperature-controller (diameter: 50 cm) to cooling a surface of the support at 30° C., and then was wound in the form of roll.

3) Provision of first backing layer:

On a surface of the film support, a solution for a first backing layer having the following composition was coated using a wire-bar coater in coated amount of 5 ml/m$^2$, and then dried at 115° C. for 2 min. to be wound in the form of roll.

| Composition | |
|---|---|
| Gelatin | 1 weight part |
| Distilled Water | 1 weight part |
| Acetic acid | 1 weight part |
| Methanol | 50 weight parts |
| Dichloroethylene | 50 weight parts |
| p-Chlorophenol | 50 weight parts |
| | 4 weight parts |

4) Provision of second backing layer (antistatic layer):

4-1) Preparation of a conductive fine particle dispersion (tin oxide-antimony oxide composite dispersing solution):

230 parts by weight of stannic chloride and 23 parts by weight of antimony trichloride were dissolved in 3,000 parts by weight of ethanol to obtain a homogeneous solution. 1N sodium hydroxide aqueous solution was dropped the solution until pH of the above solution became 3 to obtain the coprecipitate of colloidal stannic oxide and antimony oxide. The coprecipitate was left standing at 50° C. for 24 hours to obtain a red brown colloidal precipitate.

The red brown colloidal precipitate was separated by centrifugation. Water was added to the precipitate to wash it by centrifugation in order to remove excessive ions. This operation was repeated three times to remove the excessive ions.

200 parts by weight of the colloidal precipitate from which the excessive ions were removed was dispersed once again into 1,500 parts by weight of water, and the dispersion was sprayed into a kiln heated to 500° C., whereby the bluish fine particle powder of the tin-oxide-antimony oxide having the average particle size of 0.005 μm was obtained. The volume resistivity of the particle was 25 Ω·cm.

After the mixed solution of 40 parts by weight of the above fine particle powder and 60 parts by weight of water was adjusted to pH 7.0 and roughly dispersed with a stirrer, it was dispersed with a horizontal type sand mill (Daino mill manufactured by WILLYA BACHOFEN AG) until the staying time became 30 minutes to prepare the dispersing solution containing a secondary agglomerate (0.05 μm) of the particle.

4-2) Preparation and provision of second backing layer:

The following composition was coated on the first backing layer so as to have a dry layer thickness of 0.3 μm and dried at 110° C. for 30 seconds. The following coating solution for covering [B] was further coated thereon so as to have a dry layer of thickness of 0.1 μm and dried at 115° C. for 3 minutes.

| Composition: | |
|---|---|
| Above conductive fine particle dispersion | 100 weight parts |
| Gelatin (lime-treated gelatin containing 100 ppm of $Ca^{2+}$) | 10 weight parts |
| Water | 270 weight parts |
| Methanol | 600 weight parts |
| Resorcin | 20 weight parts |
| Polyoxyethylene nonylphenyl ether (I-13 described in Japanese Patent Publication No. 3(1991)-27099) | 0.1 weight part |

5) Formation of knurled area

On both sides of the surface having no backing layer of the film support, unevenness (knurled area) having a height from a surface of the support shown in Table 2a was formed using a knurling tool (pressure: 2 kg, temperature: 150° C.). The knurling tool had a surface on which concave portion and convex portion were alternately formed at intervals of 0.5 mm. The knurled area was formed on an area between an edge of the film support to 10 mm from the edge.

6) Heat treatment of support:

After the knurled area was formed on the support film in the above procedure, the resultant film support was wound around the following core in the following conditions.

Core: diameter of 300 mm, length of 1,800 mm

Conditions for winding: initial tension of 30 kg/m, final tension of 10 kg

The obtained roll of the support film was placed in a thermostat* of a high temperature and allowed to stand for 36 hours.

*Note: the support of PEN was placed in the thermostat of 110° C., the support of PET in the thermostat of 70° C., and the support of PEN/PET(=4/1) in the thermostat of 94° C.

The winding was performed in such a manner that the second backing layer was in contact with the surface of the core.

7) Provision of subbing layer

The coating solution for a subbing layer having the following composition was coated using a wire-bar coater on the glow discharged surface (surface having no backing layer) of the support in the coated amount of 10 ml/m$^2$, to be wound.

| Subbing Layer Composition: | |
|---|---|
| Gelatin | 10 weight parts |
| Water | 24 weight parts |
| Methanol | 961 weight parts |
| Salicylic acid | 3 weight parts |
| Polyamide/epichlorohydrin resin (described in Synthetic Example I of Japanese Patent Provisional Publication No. 51(1976)-3619) | 0.05 weight part |
| Nonionic surfactant (I-13 described above) | 0.1 weight part |

8) Provision of third backing layer:

On a surface of the second backing layer of the film support, a solution for a third backing layer having the following composition was coated and then dried at 115° C. to form a third backing layer of a thickness of 1.2 μm.

| Composition: | |
|---|---|
| Cellulose diacetate | 100 weight parts |
| Trimetylolpropane-3-tolylene diisocyanate | 25 weight parts |
| Methyl ethyl ketone | 1,050 weight parts |
| Cyclohexanone | 1,050 weight parts |

9) Provision of forth backing layer (slide layer):

All gradients of the composition A were dissolved by heating at 90° C. to prepare a solution A. The solution A was added to a solution of the composition B, and dispersed using a high-pressure homogenizer to prepare a solution for a forth backing layer.

| Composition A | |
|---|---|
| Slide agent 1 [$C_6H_{13}CH(OH)(CH_2)_{10}COOC_{40}H_{81}$] | 0.7 weight part |
| Slide agent 2 [n-$C_{17}H_{35}COOC_{40}H_{81}$] | 1.1 weight part |
| Xylene | 2.5 weight parts |
| **Composition B** | |
| Propylene glycol monomethyl ether | 34 weight parts |
| Cellulose diacetate | 3 weight parts |
| Acetone | 600 weight parts |
| Cyclohexanone | 350 weight parts |

On a surface of the third backing layer of the film support, a solution for a forth backing layer was coated using a wire-bar coater in a coated amount of 10 cc/m$^2$ to form a forth backing layer.

10) Provision of the silver halide emulsion layer:

Subsequently, silver halide emulsion layers (total thickness: 19.6 μm) having the following compositions were coated on an area shown Table 2a, in order, and wounded in the form of roll to prepare a continuous multi-layer color photographic sheet having ISO sensitivity of 400.

Composition of silver halide emulsion layers:

Materials used for the silver halide emulsion layers are classified as follows:

| | |
|---|---|
| ExC: Cyan coupler | UV: UV absorber |
| EM: Magenta coupler | HBS: High boiling solvent |
| ExY: Yellow coupler | H: Gelatin hardener |
| ExS: Sensitizing dye | |

The composition and its amount (g/m$^2$) of each of the layers set forth below. The amount of each component means the coating amount. The values for the silver halide emulsion mean the coating amount of silver. As for the sensitizing dyes, the coating amount per mole of the silver halide in the same layer is shown in terms of mole.

| The first layer (antihalation layer): | |
|---|---|
| Black colloidal silver | 0.09 |
| Gelatin | 1.60 |
| ExM-1 | 0.12 |
| ExF-1 | $2.0 \times 10^{-3}$ |
| Solid dispersion dye ExF-2 | 0.030 |
| Solid dispersion dye ExF-3 | 0.040 |
| HBS-1 | 0.15 |
| HBS-2 | 0.02 |
| **The second layer (intermediate layer):** | |
| Silver iodobromide Emulsion M | silver: 0.065 |
| ExC-2 | 0.04 |
| Olyethylacrylate latex | 0.20 |
| Gelatin | 1.04 |
| **The third layer (low-sensitivity red sensitive emulsion layer):** | |
| Silver iodobromide Emulsion A | silver: 0.25 |
| Silver iodobromide Emulsion B | silver: 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |

-continued

| | |
|---|---|
| The fourth layer (middle-sensitivity red sensitive emulsion layer): | |
| Silver iodobromide Emulsion C | silver: 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.010 |
| Gelatin | 0.75 |
| The fifth layer (high-sensitivity red sensitive emulsion Y layer): | |
| Silver iodobromide Emulsion D | silver: 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| The sixth layer (Intermediate layer): | |
| Cpd-1 | 0.090 |
| Solid dispersion dye Exf-4 | 0.030 |
| HBS-1 | 0.050 |
| Polyethylarylate latex | 0.15 |
| Gelatin | 1.10 |
| The seventh layer (low-sensitivity green sensitive emulsion (layer): | |
| Silver iodobromide Emulsion E | silver: 0.15 |
| Silver iodobromide Emulsion F | silver: 0.10 |
| Silver iodobromide Emulsion G | silver: 0.10 |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| Yellow colloidal silver | silver: 0.015 |
| Cpd-1 | 0.16 |
| Solid dispersion dye ExF-5 | 0.060 |
| Solid dispersion dye ExF-6 | 0.060 |
| Oil-soluble dye ExF-7 | 0.010 |
| HBS-1 | 0.60 |
| Gelatin | 0.60 |
| The eleventh layer (low-sensitivity blue sensitive emulsion) layer): | |
| Silver iodobromide Emulsion J | silver: 0.09 |
| Silver iodobromide Emulsion K | silver: 0.09 |
| ExS-7 | $8.6 \times 10^{-4}$ |
| ExC-8 | $7.6 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| The twelfth layer (high-sensitivity blue sensitive emulsion layer): | |
| Silver iodobromide Emulsion L | silver: 1.00 |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |

-continued

| | |
|---|---|
| HBS-1 | 0.070 |
| Gelatin | 0.70 |
| The thirteenth layer (first protective layer): | |
| UV-1 | 0.19 |
| UV-2 | 0.075 |
| UV-3 | 0.065 |
| ExF-8 | 0.045 |
| ExF-9 | 0.050 |
| HBS-1 | $5.0 \times 10^{-2}$ |
| HBS-4 | $5.0 \times 10^{-2}$ |
| Gelatin | 1.8 |
| The fourteenth layer (second protective layer): | |
| Silver iodobromide Emulsion M | silver: 0.10 |
| H-1 | 0.40 |
| B-1 (diameter: 1.7 μm) | 0.050 |
| B-2 (diameter: 1.7 μm) | 0.15 |
| B-3 | 0.05 |
| S-1 | 0.20 |
| Gelatin | 0.70 |

To each layer, the compounds of W-1 to W-3, B-4 to B-6, F-1 to F-17, an iron salt, a lead salt, a gold salt, a platinum salt, an iridium salt and a rhodium salt were appropriately incorporated, in order to improve preservation performance, processing performance, antipressure performance, antimold and fungicidal performance, antistatic performance, and coating performance.

Emulsion composition used in each layer set forth in Table 1.

TABLE 1

| Emulsion | mean AgI content (%) | coefficient of variation of content (%) | mean grain size (μm) | coefficient of variation of size (%) | diameter of projected plane (μm) | diameter/thickness |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

In Table 1;

(1) Emulsions J to L were subjected to a reduction sensitization with thiourea dioxide and thiosulfonic acid in the preparation of the grains according to the examples described in Japanese Patent Provisional Publication No. 2(1990)-191938.

(2) Emulsions A to I were subjected to a gold sensitization, a sulfur sensitization and a selenium sensitization in the presence of the spectral sensitizing dyes described in the respective layers and sodium thiocyanate according to the examples of Japanese Patent Provisional Publication No. 3(1991)-237450.

(3) Low molecular weight gelatin was used for the preparation of the tabular grains according to the examples described in Japanese Patent Provisional Publication No. 1(1989)-158426.

(4) The dislocation lines described in Japanese Patent Provisional Publication No. 3(1991)-237450 were observed in the tabular grains and regular crystal grains having a grain structure with a high pressure electron microscope.

(5) Emulsion L was double structure grain having a core containing internal high-concentration-iodine which is described in Japanese Patent Provisional Publication No. 60(1985)-143331.

[Preparation of dispersion of solid dispersion dye]

Solid dispersion dye ExF-2 was dispersed as follows:

In a 700 ml pot mill, 21.7 ml of water, 3 ml of sodium p-octylphenoxyethoxyethoxyethane sulfonate 5% aqueous solution and 0.5 g of p-octylphenoxypolyoxyethylene ether (polymerization degree: 10) 5% aqueous solution were placed, and further 5.0 g of ExF-2 and 500 ml of zirconium oxide beads (diameter: 1 mm) were added to prepare a mixture. The mixture was dispersed for 2 hours using a vibration ball mill (BO type, available from Chyuo Koki Co., Ltd.). To the resultant dispersion, 8 g of gelatin 12.5% aqueous solution was added, and the beads were removed to prepare a gelatin dispersion of dye ExF-2. The dye was a particle having means particle size of 0.44 μm.

Dispersions of solid dispersion dyes (ExF-3, ExF-4 and ExF-6) were obtained in the same manner as above. These particle sizes were 0.24 μm, 0.45 μm and 0.52 μm, respectively.

Dispersion of solid dispersion dye (ExF-5) was obtained using a dispersing method of microprecipitation described in Example 1 of EP 549,484 A. The particle size was 0.06 μm.

The abbreviations of the components used in the respective layers mean the following compounds:

ExC-1

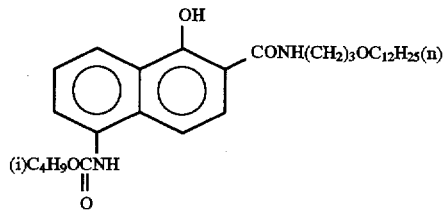

ExC-2

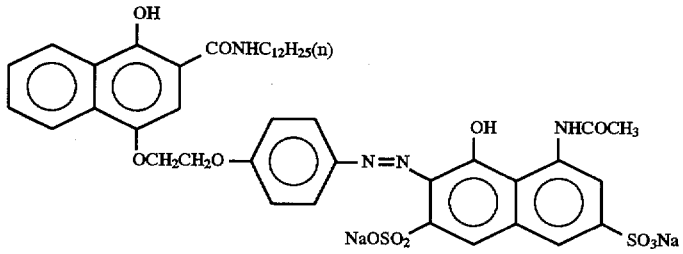

ExC-3

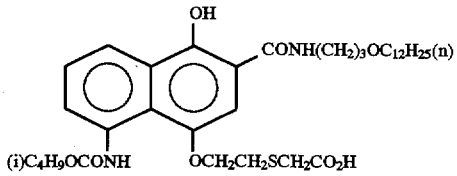

ExC-4

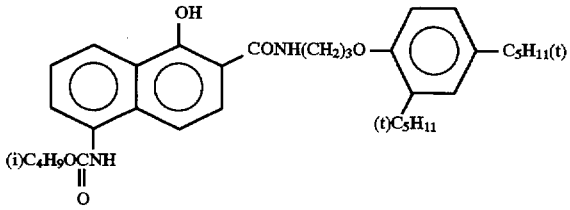

ExC-5

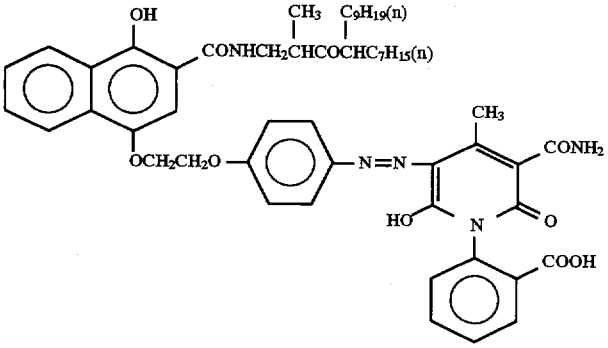

-continued
ExC-6
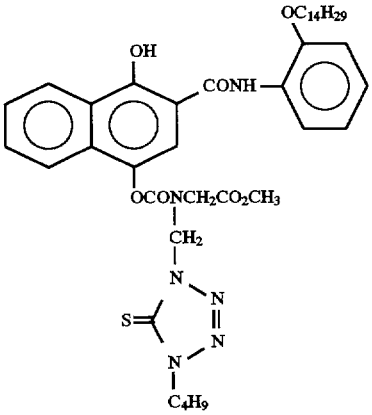
ExC-7
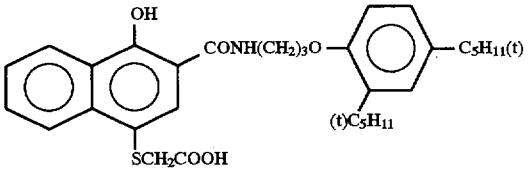
ExC-8
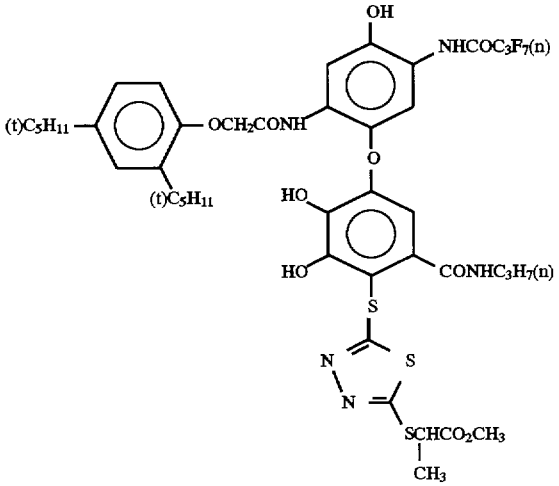
ExM-1
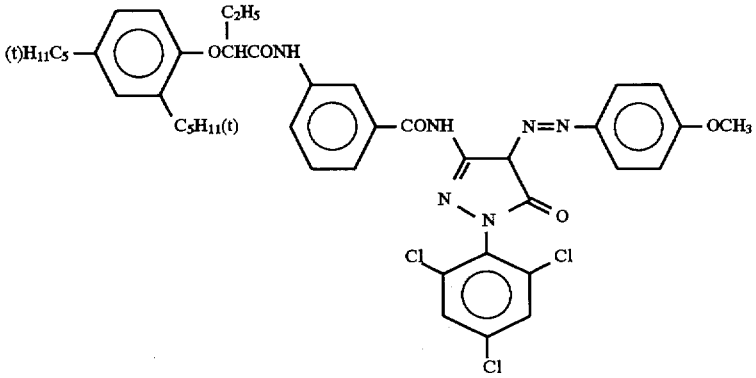

-continued
ExM-2
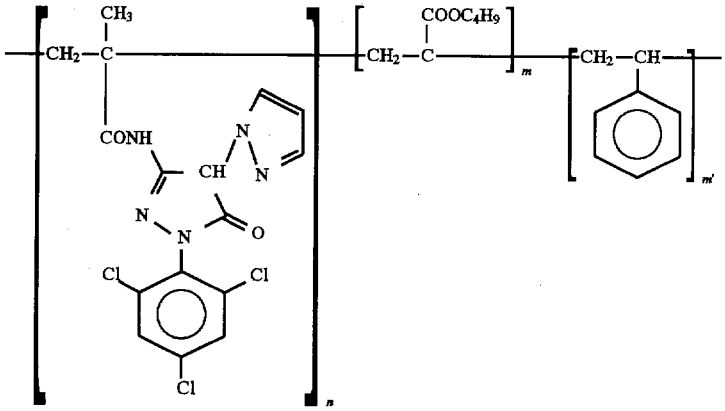
n = 50, m = 25, m' = 25, mol. wt. = approx. 20.000
ExM-3
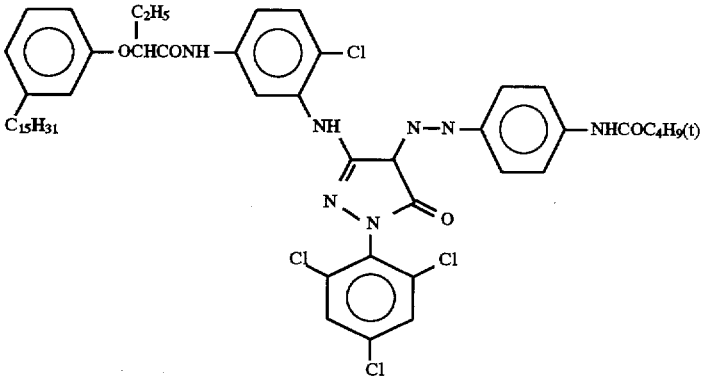
ExM-4
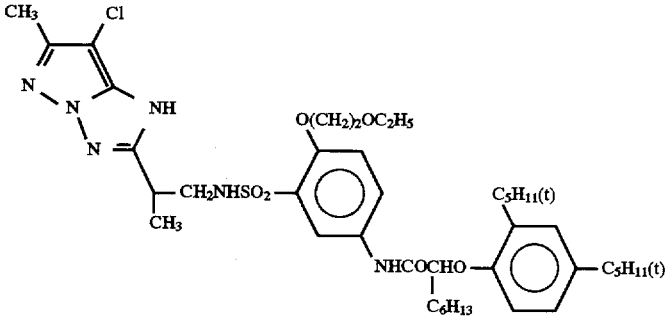
ExM-5
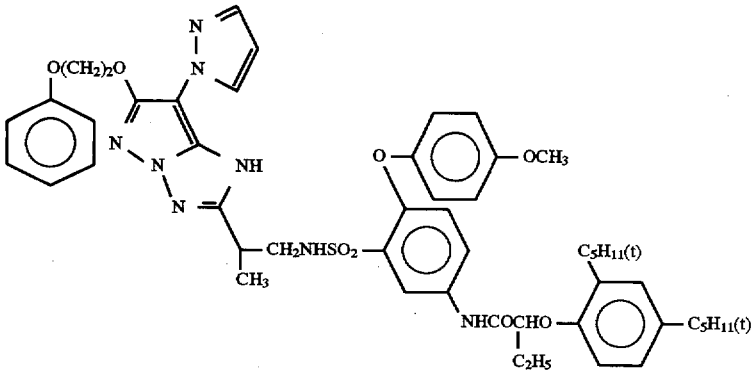

-continued
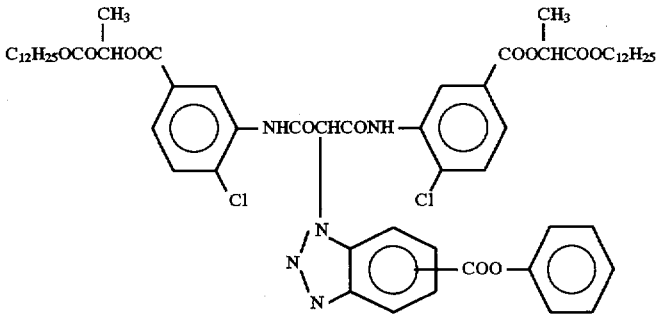
ExY-1
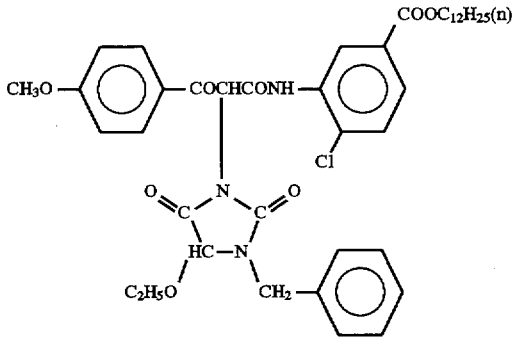
ExY-2
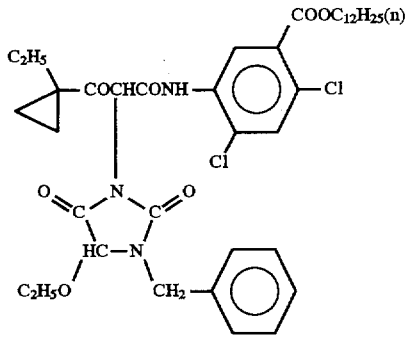
ExY-3
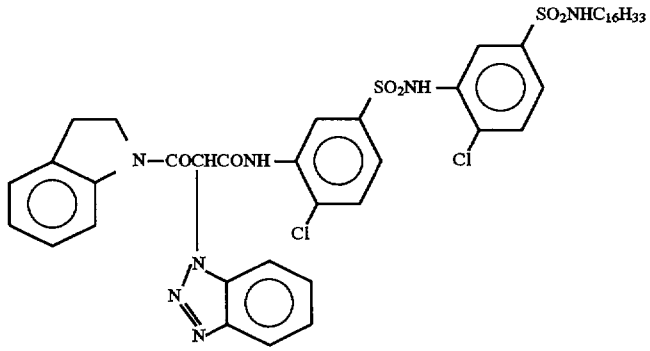
ExY-4

-continued
ExY-5
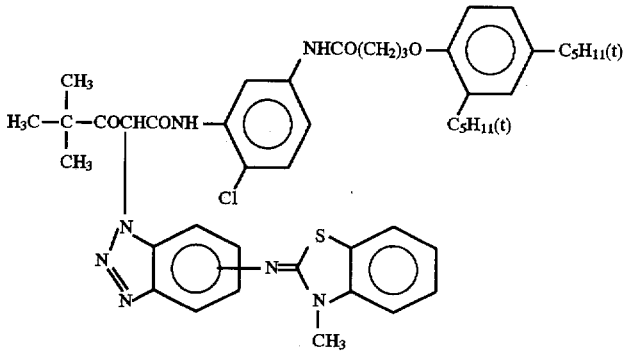
ExF-1
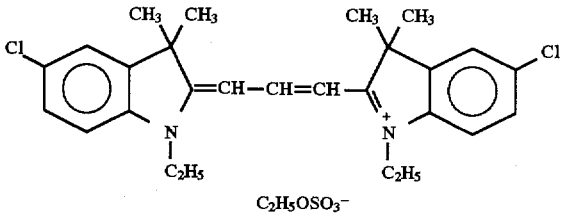
ExF-2
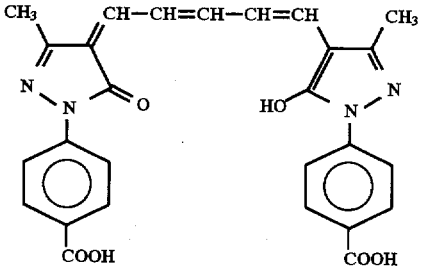
ExF-3
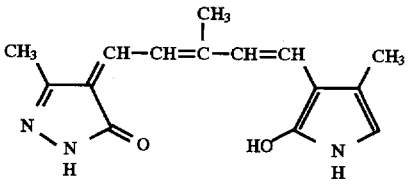
ExF-4
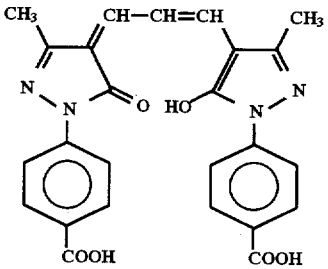
ExF-5
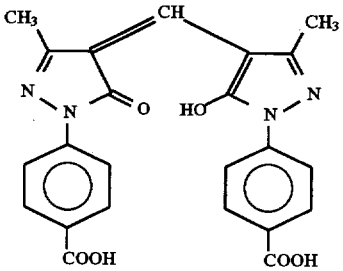

-continued
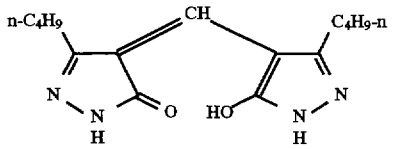
ExF-6
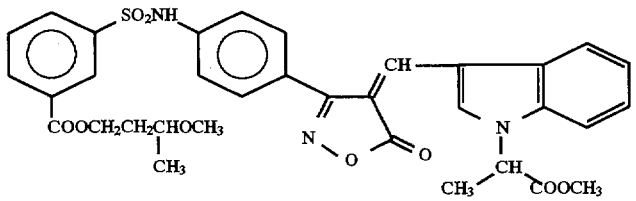
ExF-7
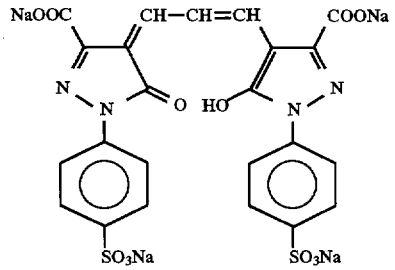
ExF-8
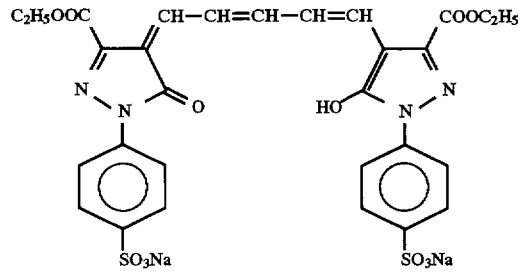
ExF-9
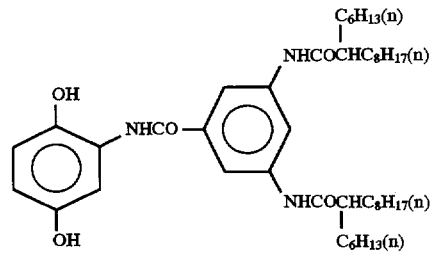
Cpd-1
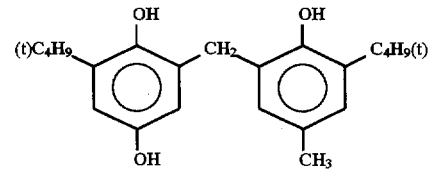
Cpd-2
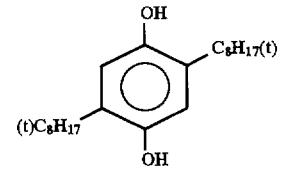
Cpd-3

-continued
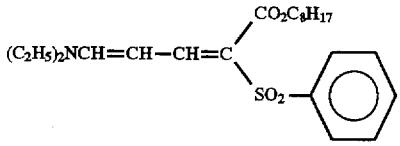
UV-1
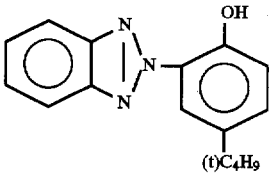
UV-2
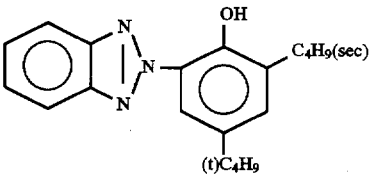
UV-3
Tricresyl phosphate HBS-1
Di-n-butyl phthalate HBS-2
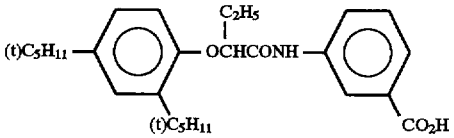
HBS-3
Tri(3-ethylhexyl)phosphate HBS-4
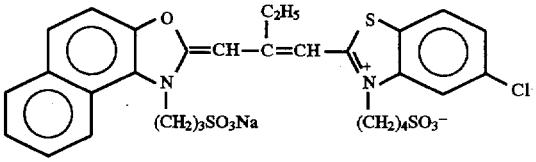
ExS-1
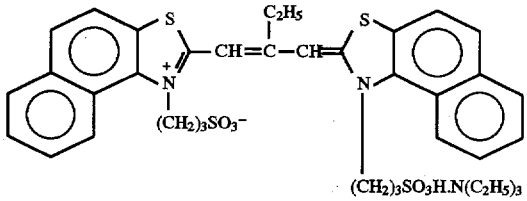
ExS-2
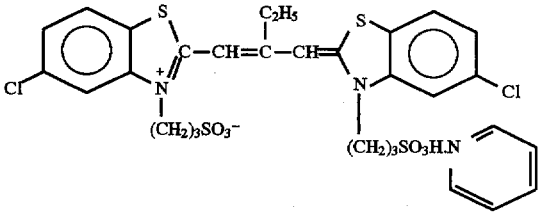
ExS-3
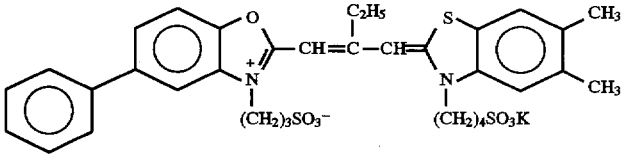
ExS-4

-continued
ExS-5
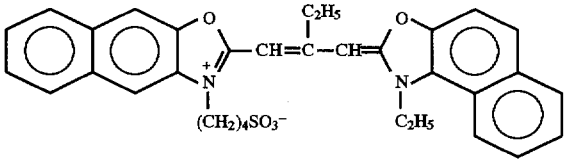
ExS-6
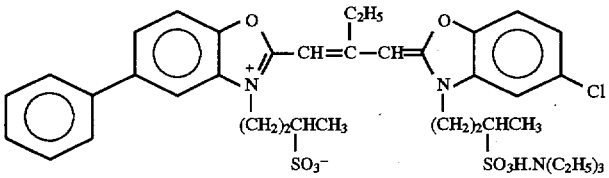
ExS-7
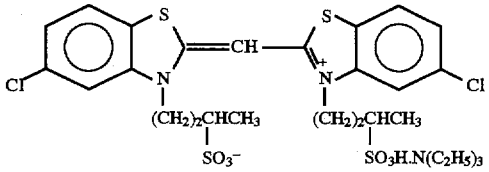
S-1
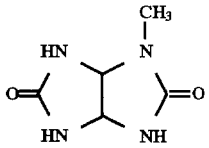
H-1
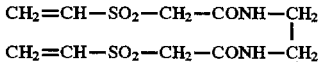
B-1
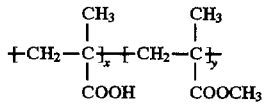
x/y = 10/90
B-2
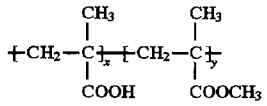
x/y = 40/60
B-3
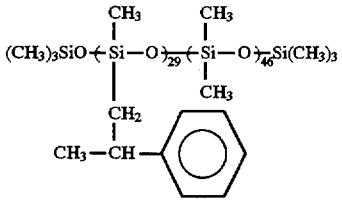
B-4
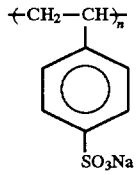
B-5
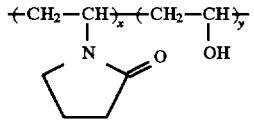
x/y = 70/30

-continued
B-6
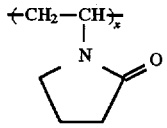
Molecular weight = approx. 10,000
W-1
$C_8F_{17}SO_2NHCH_2CH_2CH_2OCH_2CH_2\overset{+}{N}(CH_3)_3$
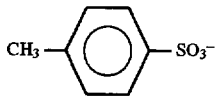
W-2
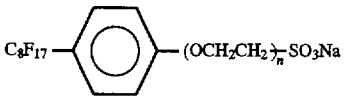
n = 2–4
W-3
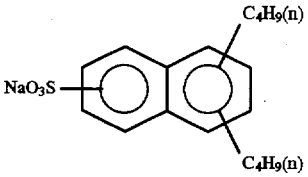
F-1
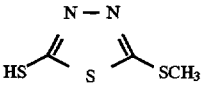
F-2
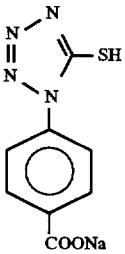
F-3
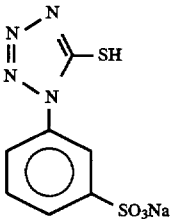
F-4
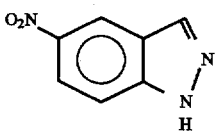
F-5
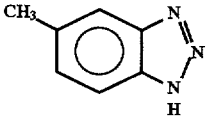
F-6
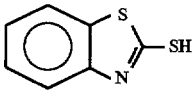

-continued

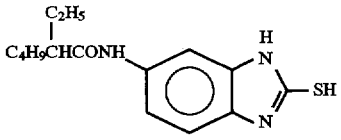

F-7

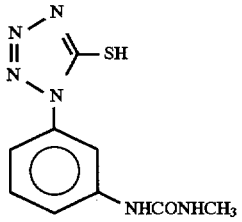

F-8

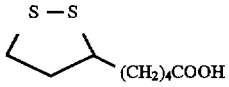

F-9

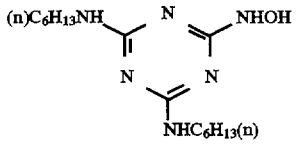

F-10

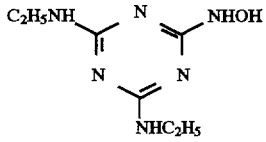

F-11

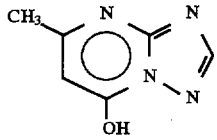

F-12

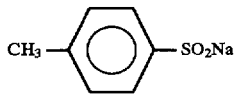

F-13

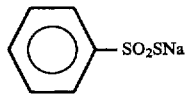

F-14

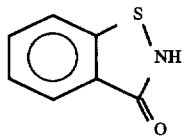

F-15

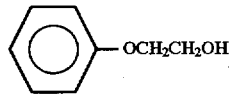

F-16

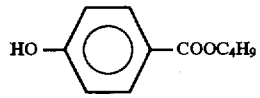

F-17

11) Evaluation of continuous support and continuous photographic sheet (1) Young's modulus A strip specimen (polymer film support) having a width of 10 mm and a length of 150 mm was attached to a universal tensile testing machine of Instron type at a distance between the fixtures of 100 mm. Then, the specimen was stretched at a tensile speed of 10 mm/minute and a chart-feeding speed of 500 mm/minute. The Young's modulus was determined based on the resultant load-elongation curve.

(2) Looseness of winding

The roll of the resultant photographic sheet was placed on a truck. The truck was allowed to move at speed of 10 km/hour, and to collide with a rubber sheet (thickness: 10 mm) stuck on a concrete wall. A difference between a top of a projected portion and a bottom of a caved portion of the side surface of the roll produced by the collision was measured.

(3) The number of scratch of length of not less than 1 mm (per 1 $m^2$)

The photographic sheet (length of 5 m) in the region of from a location (0 m) of an initial winding position of the core of the roll to that of 5 m from the position was observed by viewing under irradiation of light of 3,000 lux.

(4) Fog by pressure

The photographic sheet in the area wound around the surface of the core of the roll was subjected to color development processing (according to Fuji color CN-16). The resultant sheet was measured by a densitometer (X-RITE Status M, manufactured by X-RITE Co., Ltd.) using blue filter (B), green filter (G) and red filter (R). Fog by pressure was indicated as transmission density of each of B, G and R.

(5) Fog by scratch

The photographic sheet in the area wound around the surface of the core of the roll was subjected to color development processing (according to Fuji color NC-16). The resultant sheet was measured by a densitometer (X-RITE Status M, manufactured by X-RITE Co., Ltd.) using blue filter (B), green filter (G) and red filter (R). Fog by scratch was indicated as transmission density of each of B, G and R.

Fog by pressure (4) and fog by scratch (5) produced on the sheet were distinguished from their shapes.

The results obtained by the above measurements are set forth in Tables 2a and 2b.

TABLE 2a

| | Young's modulus | | | Knurled area | | Area of Emulsion in | Tension | |
|---|---|---|---|---|---|---|---|---|
| | Length ($kg/mm^2$) | Width | Polymer | Width (mm) | Height (μm) | knurled area (%) | Initial (kg/m) | Final (kg/m) |
| Comp. Ex. 1 | 570 | 600 | PEN | 10 | 20 | 0 | 70 | 60 |
| Comp. Ex. 2 | 570 | 600 | PEN | 10 | 20 | 3 | 70 | 60 |
| Example 1 | 570 | 600 | PEN | 10 | 20 | 5 | 70 | 60 |
| Example 2 | 570 | 600 | PEN | 10 | 20 | 25 | 70 | 60 |
| Example 3 | 520 | 550 | PEN/PET | 10 | 20 | 50 | 70 | 60 |
| Example 4 | 570 | 600 | PEN | 10 | 20 | 75 | 70 | 60 |
| Example 5 | 570 | 600 | PEN | 10 | 20 | 95 | 70 | 60 |
| Comp. Ex. 3 | 570 | 600 | PEN | 10 | 20 | 100 | 70 | 60 |
| Example 6 | 570 | 600 | PEN | 10 | 20 | 25 | 120 | 110 |
| Example 7 | 570 | 600 | PEN | 10 | 20 | 25 | 100 | 100 |
| Example 8 | 570 | 600 | PEN | 10 | 20 | 25 | 100 | 90 |
| Example 9 | 570 | 600 | PEN | 10 | 20 | 25 | 30 | 30 |
| Example 10 | 460 | 480 | PET | 10 | 20 | 25 | 70 | 60 |
| Example 11 | 570 | 600 | PEN | 10 | 20 | 35 | 70 | 60 |

TABLE 2b

| | Looseness of winding | Number of scratch | Fog by pressure | | | Fog by scratch | | |
|---|---|---|---|---|---|---|---|---|
| | (mm) | ($/mm^2$) | B | G | R | B | G | R |
| Comp. Ex. 1 | 0 | >100 | 0.02 | 0.03 | 0.02 | 0.07 | 0.10 | 0.05 |

TABLE 2b-continued

| | Looseness of winding | Number of scratch | Fog by pressure | | | Fog by scratch | | |
|---|---|---|---|---|---|---|---|---|
| | (mm) | ($/mm^2$) | B | G | R | B | G | R |
| Comp. Ex. 2 | 0 | 74 | 0.02 | 0.03 | 0.02 | 0.07 | 0.09 | 0.05 |
| Example 1 | 0 | 0 | 0.01 | 0.01 | 0.01 | 0.00 | 0.00 | 0.00 |
| Example 2 | 0 | 0 | 0.01 | 0.01 | 0.01 | 0.00 | 0.00 | 0.00 |
| Example 3 | 0 | 0 | 0.01 | 0.01 | 0.01 | 0.00 | 0.00 | 0.00 |
| Example 4 | 0 | 0 | 0.01 | 0.01 | 0.01 | 0.00 | 0.00 | 0.00 |
| Example 5 | 0 | 0 | 0.01 | 0.01 | 0.01 | 0.00 | 0.00 | 0.00 |
| Comp. Ex. 3 | 52 | 0 | 0.01 | 0.01 | 0.01 | 0.00 | 0.00 | 0.00 |
| Example 6 | 0 | 0 | 0.03 | 0.04 | 0.03 | 0.00 | 0.00 | 0.00 |
| Example 7 | 0 | 0 | 0.01 | 0.01 | 0.01 | 0.00 | 0.00 | 0.00 |
| Example 8 | 0 | 0 | 0.01 | 0.01 | 0.01 | 0.00 | 0.00 | 0.00 |
| Example 9 | 3 | 0 | 0.01 | 0.01 | 0.01 | 0.00 | 0.00 | 0.00 |
| Example 10 | 0 | 0 | 0.01 | 0.01 | 0.01 | 0.00 | 0.00 | 0.00 |
| Example 11 | 1 | 0 | 0.01 | 0.01 | 0.01 | 0.00 | 0.00 | 0.00 |

What is claimed is:

1. A process for preparing a continuous silver halide photographic sheet which comprises the steps of:

forming at least one subbing layer on a continuous support of polymer film having a width of 1 to 5 m and a length of 1,000 to 5,000 m and which has a Young's modulus in the range of 450 to 650 $kg/mm^2$ in both of its length and width directions and has a knurled area in the form of a belt on each side which knurled areas have protrusions of an average height of 5 to 50 μm, said height measured from the support in the area between both knurled areas, and which knurled areas have a width of 3 to 20 mm; and coating at least one silver halide emulsion on the subbing layer not only in an area between both knurled areas but also in the knurled areas under the condition that each of the knurled areas has an area in the form of a belt having emulsion coating which has a width of 5 to 95% of the width of the belt of knurled area to give a silver halide emulsion layer having a thickness of 15 to 30 μm.

2. The process according to claim 1, wherein the support of polymer film comprises an aromatic polyester.

3. The process according to claim 1, wherein the support of polymer film comprises poly(ethylene terephthalate) or poly(ethylene-2,6-naphthalate).

4. The process according to claim 1, wherein the support of polymer film has a thickness of 60 to 100 μm.

5. A process according to claim 1, wherein the knurled areas have protrusions of an average height of 15 to 30 μm.

6. A process according to claim 1, wherein the knurled areas have a width of 5 to 15 mm.

7. A process according to claim 1, wherein the areas in the form of a belt having emulsion coating have a width of 10 to 50% of the width of the belt of knurled areas.

8. A continuous silver halide photographic sheet which comprises:

a continuous support of a polymer film having a width of 1 to 5 m and a length of 1,000 to 5,000 m and which has Young's modulus in the range of 450 to 650 $kg/mm^2$ in both of its length and width directions and has a knurled area in the form of a belt on each side which knurled areas have protrusions of an average height of 5 to 50 μm, said height measured from the support in the area between both knurled areas, and which knurled areas have a width of 3 to 20 mm;

at least one subbing layer formed on the support, and at least one silver halide emulsion layer having a thickness of 15 to 30 μm coated on the subbing layer not only in an area between both knurled areas but also in the knurled areas under the condition that each of the knurled areas has an area in the form of a belt having emulsion coating which has a width of 5 to 95% of the width of the belt of knurled area.

9. The photographic sheet according to claim 8, wherein the support of polymer film comprises an aromatic polyester.

10. The photographic sheet according to claim 8, wherein the support of polymer film comprises poly(ethylene terephthalate) or poly(ethylene-2,6-naphthalate).

11. The photographic sheet according to claim 8, wherein the support of polymer film has a thickness of 60 to 100 μm.

12. A photographic sheet according to claim 8, wherein the knurled areas have protrusions of an average height of 15 to 30 μm.

13. A photographic sheet according to claim 8, wherein the knurled areas have a width of 5 to 15 mm.

14. A photographic sheet according to claim 8, wherein the areas in the form of a belt having emulsion coating have a width of 10 to 50% of the width of the belt of knurled areas.

15. The photographic sheet according to claim 8, wherein is wound to give a continuous photographic sheet in the form of a roll.

* * * * *